US006570554B1

(12) United States Patent
Makino et al.

(10) Patent No.: US 6,570,554 B1
(45) Date of Patent: May 27, 2003

(54) LIQUID CRYSTAL DISPLAY

(75) Inventors: Tetsuya Makino, Kawasaki (JP); Toshiaki Yoshihara, Kawasaki (JP); Hironori Shiroto, Kawasaki (JP); Yoshinori Kiyota, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 203 days.

(21) Appl. No.: 09/658,553

(22) Filed: Sep. 8, 2000

(30) Foreign Application Priority Data

Nov. 8, 1999 (JP) ..... 11-317466

(51) Int. Cl.[7] ..... G09G 3/36
(52) U.S. Cl. ..... 345/102; 345/88
(58) Field of Search ..... 345/87, 88, 89, 345/98, 100, 99, 102, 103, 94, 95, 96, 97; 349/61, 68, 69, 70

(56) References Cited

U.S. PATENT DOCUMENTS 4,975,694 A * 12/1990 McLaughlin et al. ..... 345/102
5,731,794 A * 3/1998 Miyazawa ..... 345/88
6,115,016 A * 9/2000 Yoshihara et al. ..... 345/88
6,392,620 B1 * 5/2002 Mizutani et al. ..... 345/88

FOREIGN PATENT DOCUMENTS

JP 7281150 10/1995
JP 10253943 9/1998

* cited by examiner

*Primary Examiner*—Xiao Wu
(74) *Attorney, Agent, or Firm*—Greer, Burns & Crain, Ltd.

(57) ABSTRACT

A liquid crystal display in which: after a back-light has emitted three-color light rays of red, green and blue sequentially color by color, the back-light is turned off for a predetermined time, or the back-light is controlled so that, in three consecutive frames, the orders of light emissions of the respective colors carried out in respective sub-frames are not coincident with each other, thereby to reduce degradation in the image quality that occurs at the outline portion of an animation picture when it is displayed.

6 Claims, 17 Drawing Sheets

FIG. 4A BACK-LIGHT EMISSION

FIG. 4B LCD PANEL SCANNING

FIG. 4C LIQUID CRYSTAL PANEL COLOR EMISSION

1 : POLARIZING FILM
2 : GLASS SUBSTRATE
3 : COMMON ELECTRODE
4 : GLASS SUBSTRATE
5 : POLARIZING FILM
22 : BACK-LIGHT { 6 : LIGHT-GUIDING AND DIFFUSING PLATE, 7 : LED ARRAY }
11 : ALIGNMENT FILM
12 : ALIGNMENT FILM
13 : LIQUID CRYSTAL LAYER
14 : SPACER
21 : LIQUID CRYSTAL PANEL
40 : PIXEL ELECTRODE

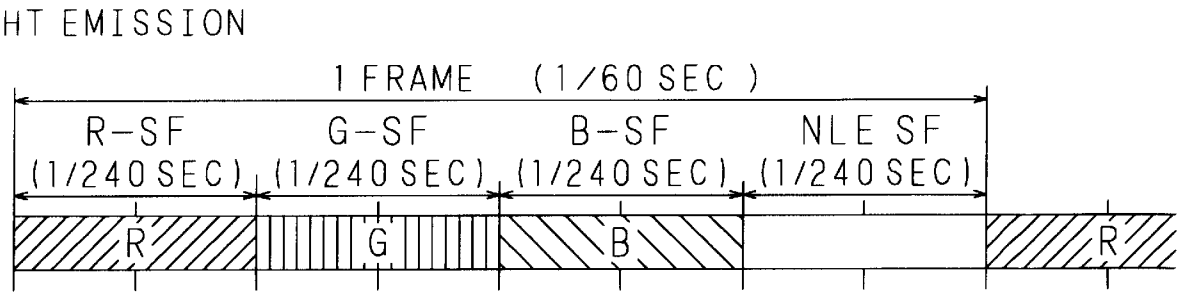
FIG. 10A BACK-LIGHT EMISSION
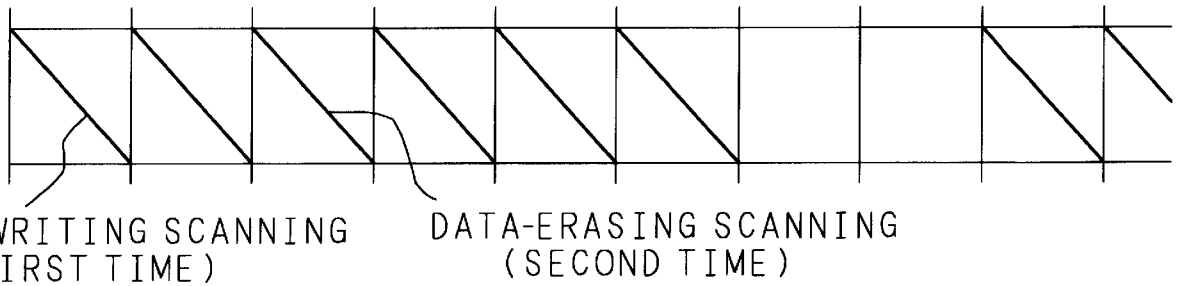
FIG. 10B LCD PANEL SCANNING
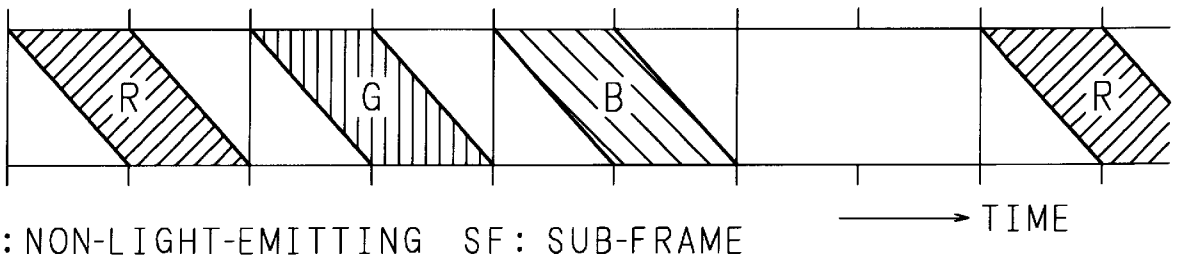
FIG. 10C LIQUID CRYSTAL PANEL COLOR EMISSION
NLE: NON-LIGHT-EMITTING SF: SUB-FRAME

FIG. 12A BACK-LIGHT EMISSION

FIG. 12B LCD PANEL SCANNING

FIG. 12C LIQUID CRYSTAL PANEL COLOR EMISSION

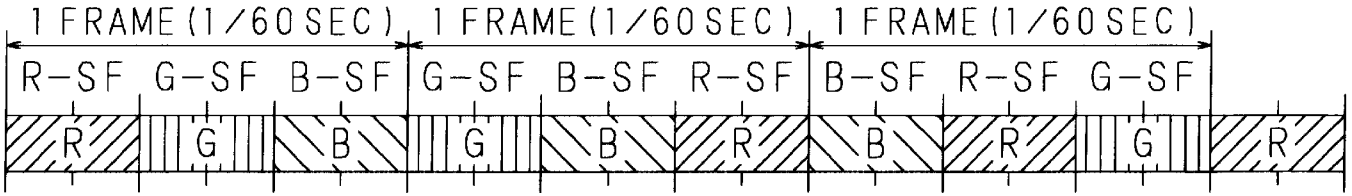
FIG. 14A BACK-LIGHT EMISSION
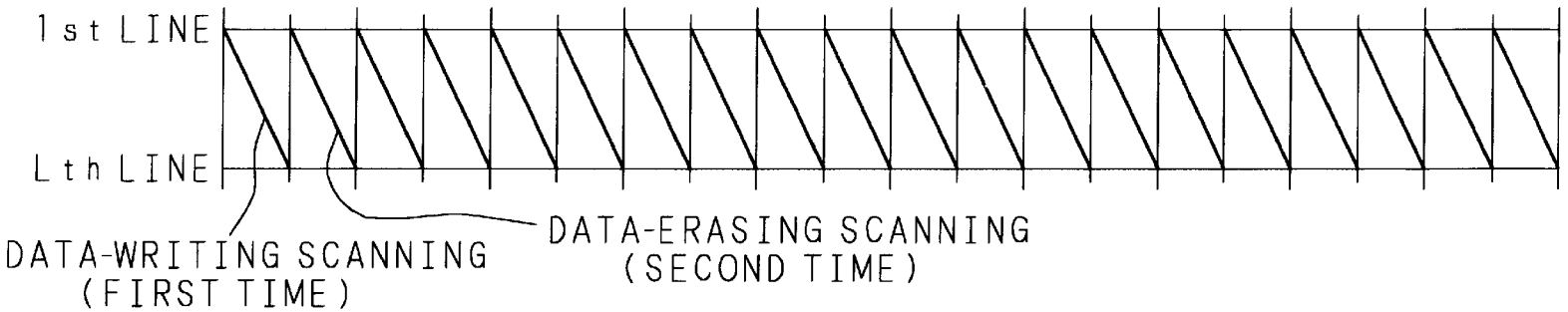
FIG. 14B LCD PANEL SCANNING
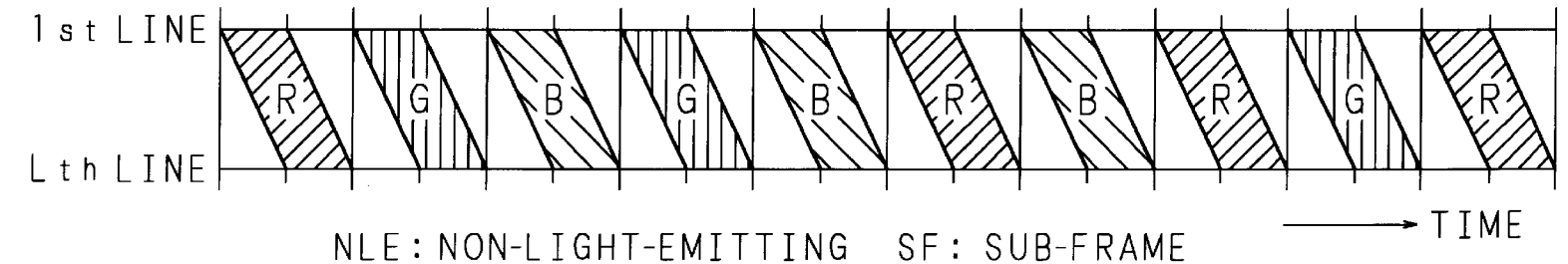
FIG. 14C LIQUID CRYSTAL PANEL COLOR EMISSION

FIG. 16A BACK-LIGHT EMISSION

FIG. 16B LCD PANEL SCANNING

FIG. 16C LIQUID CRYSTAL PANEL COLOR EMISSION

LIQUID CRYSTAL DISPLAY

BACKGROUND OF THE INVENTION

The present invention relates to a liquid crystal display, and more particularly to a liquid crystal display using a ferroelectric liquid crystal or an anti-ferroelectric liquid crystal.

Along with the recent developments of the so-called office automation (0A), 0A apparatuses, typically exemplified by word-processors and personal computers, have been widely used. As such 0A apparatuses have become prevalent in offices, there have been ever-increasing demands for portable-type 0A apparatuses that can be used in offices as well as outdoors, and there have been also demands for small-size and light-weight of such apparatuses. Here, liquid crystal displays have come to be widely used as one of the means to achieve such an objective. Liquid crystal displays not only achieve small-size and light-weight, but also include an indispensable technique in an attempt to achieve low power consumption in portable 0A apparatuses that are driven by batteries.

The liquid crystal displays are mainly classified into the reflection-type and the transmission-type. In, the reflection-type liquid crystal displays, light rays that have been made incident on the front face of a liquid crystal panel are reflected by the back face of the liquid crystal panel so that an image is visualized by the reflected light. In the transmission-type liquid crystal displays, transmitted light from a light source (backlight) placed behind the back face of a liquid crystal panel is used to visualize an image. Although those of the reflection-type are inferior in visibility due to irregularity in the amount of reflected light that depends on environment conditions, they are inexpensive and widely used as display devices with mono-color (for example, black/white display, etc.) for such as calculators and watches. However, they are not suitable for display devices for personal computers, etc. which carry out a multi-color or full-color display. For this reason, in general, transmission-type liquid crystal displays are used as display devices for personal computers, etc. which carry out a multi-color or full-color display.

Here, currently-used color liquid crystal displays are generally classified into the STN (Super Twisted Nematic) type and the TFT-TN (Thin Film Transistor-Twisted Nematic) type based upon the liquid crystal type to be used. Although those of the STN type have comparatively low manufacturing costs, they are susceptible to cross-talk, and comparatively slow in response speeds; therefore, they are not suitable for display for animation pictures. In contrast, those of the TFT-TN type have higher display quality as compared with the STN type; however, since, at present, their liquid crystal panel has a light transmittance as low as 4%, a back-light with high luminance is required. For this reason, those of the TFT-TN type have greater power consumption due to the back-light, resulting in a problem in use of carrying battery power-source. Moreover, the TFT-TN type have other problems with the response speed, particularly slow in response speed for displaying half tones, narrow viewing angle, difficulty in adjusting the color balance, etc.

Moreover, in the conventional liquid crystal displays, a back-light of white light is used and the white light is selectively transmitted through color filters of three primary colors so as to perform a multi-color or full-color display; that is, those of the color-filter type have been generally used. However, in the color-filter type, a display pixel is constituted by a certain area including adjacent three color filters as one unit; therefore, the resolution is lowered to virtually one-third. Moreover, the application of the color filters reduces the transmittance of the liquid crystal panel, resulting in a reduction in the luminance as compared with the case without color filters.

In order to solve the above-mentioned problems, a liquid crystal display (Japanese Patent Application Laid-Open No. 7-281150, etc.) has been proposed in which a ferroelectric liquid crystal element or an anti-ferroelectric liquid crystal element, which has a high response speed to an applied electric field, is used as its liquid crystal element, and the same pixel is allowed to emit light rays with the three primary colors sequentially color by color so as to provide a color display.

FIGS. 1 and 2 are graphs respectively show the electro-optical characteristics of the ferroelectric liquid crystal and anti-ferroelectric liquid crystal. As shown in FIG. 1, the light transmittance of the ferroelectric liquid crystal varies depending on the polarity of an applied voltage. In the case of the plus application, the light-transmittance increases in response to the applied voltage, and in the case of the minus application, the light-transmittance becomes zero independent of the magnitude of the applied voltage. Moreover, as shown in FIG. 2, the light-transmittance of the anti-ferroelectric liquid crystal increases in response to the applied voltage in both of the cases of the plus and minus applications, and in the case of zero of the voltage application, the light-transmittance becomes zero. Therefore, in the case when these ferroelectric liquid crystal and anti-ferroelectric liquid crystal are applied to a liquid crystal display, a voltage corresponding to pixel data is supplied to each pixel of a liquid crystal panel and the light-transmittance is adjusted so that a display is available.

In a liquid crystal display using a ferroelectric liquid crystal or an anti-ferroelectric liquid crystal having the above-mentioned electro-optical characteristics, a liquid crystal panel, which uses a ferroelectric liquid crystal element or an anti-ferroelectric liquid crystal element that is capable of a high-speed response in hundreds to several $\mu$ seconds order, and a back-light capable of emitting red, green and blue light rays in a time-divided manner are combined, and by synchronizing the switching of the liquid crystal element and the light emission of the back-light a color display is realized. In the case when the ferroelectric liquid crystal element or the anti-ferroelectric liquid crystal element is used as the liquid crystal material, the liquid crystal molecules are constantly maintained in parallel with the substrate (glass substrate) so that it is possible to provide a very wide viewing angle; therefore, no problem arises in practical use. Moreover, in the case when a back-light constituted by red, green and blue light-emitting diodes (LEDs) is used, it is possible to adjust the color balance by controlling currents flowing through the respective LEDs.

FIG. 3 is a block diagram that shows one example of the structure of a conventional liquid crystal display. To an image memory 52 included in a display control means 51 is supplied display data DD to be displayed on a liquid crystal panel 53 from, for example, an externally personal computer, etc. The image memory 52 temporarily stores the display data DD, and then transfers data of each pixel unit (hereinafter, referred to as pixel data PD) to a data driver 55, and the data driver 55 outputs the pixel data PD thus transferred. Moreover, the display control means 51 outputs a control signal to a scan driver 56, and the scan driver 56 controls the on/off operations of scan lines installed within the liquid crystal display panel 53. Furthermore, the display control means 51 supplies a driving voltage to a back-light 54 so as to allow an LED array included in the back-light 54 to emit light.

FIG. 4 is a time chart that shows one example of a conventional display control carried out in such a liquid crystal display. FIG. 4A shows timing of light emissions of the LEDs of respective red, green and blue colors of the back-light 54, FIG. 4B shows scanning timing of respective lines of the liquid crystal panel 53, and FIG. 4C shows color-emitting states of the liquid crystal panel 53.

As illustrated in FIG. 4A, the LEDs in the back-light 54 are allowed to emit light successively in the order of red, green and blue, for example, for each 1/180 second, and in synchronism with this, the respective pixels of the liquid crystal panel 53 are switched on a line basis so as to provide a display. Here, in the case of a display of 60 frames for one second, one frame period is a 1/60 second, and this one frame period is further divided into three sub-frames, each having a 1/180 second. For instance, in the example shown in FIG. 4A, the red LED is allowed to emit light in the first sub-frame, the green LED is allowed to do so in the second sub-frame, and the blue LED is allowed to do so in the third sub-frame, respectively.

As illustrated in FIG. 4B, with respect to the liquid crystal panel 53, data scanning is carried out twice for each of the sub-frames of the respective red, green and blue colors. However, adjustments in timing are conducted so that the start timing (timing to the first line) of the first scanning (data-writing scanning) is coincident with the start timing of each sub-frame and so that the end timing (timing to the final line) of the second scanning (data-erasing scanning) is coincident with the end timing of each sub-frame.

During the data-writing scanning process, a voltage corresponding to pixel data PD is supplied to each pixel of the liquid crystal panel 53 so as to adjust the transmittance. Thus, it becomes possible to provide a full color display. In contrast, during the data-erasing scanning process, an electrical potential having the same voltage as that of the data-writing scanning process, but the reversed polarity thereto, is supplied to each pixel in the liquid crystal panel 53; thus, the display in each pixel in the liquid crystal panel 53 is erased so that it is possible to prevent a DC component from being applied to the liquid crystal.

However, in such a conventional liquid crystal display, there is a phenomenon in which, in the case of displaying an animation picture, the outline portion of the moving picture is observed as a rainbow colored portion. The following description will discuss the cause of this phenomenon.

FIG. 5 is an explanatory drawing that shows a model of an animation picture displayed on the liquid crystal panel by the above-mentioned conventional liquid crystal display. In FIG. 5, the axis of ordinate is the time axis, and the axis of abscissa represents a pixel on a certain line in the liquid crystal panel 53. Pixel numbers placed on the axis of abscissa are numbers that are assigned for convenience of explanation so as to identify pixels on the line shown in FIG. 5.

In this case, an animation picture displayed on the liquid crystal panel 53 is designed so that a white-color image corresponding to 8 pixels on the black background is allowed to shift six pixels for each frame in the increasing direction of the pixel numbers. Therefore, as illustrated in FIG. 5, in the red sub-frame (R-SF) within the n−1 frame, red display data corresponding to pixel m to pixel m+7 are displayed. In the same manner, in the green sub-frame (G-SF) and the blue sub-frame (B-SF) within the n−1 frame, green display data and blue display data corresponding to pixel m to pixel m+7 are respectively displayed.

Moreover, in the respective red, green and blue sub-frames within the n frame, red, green and blue display data, which correspond to pixel m+6 to pixel m+13 (not shown) that have shifted six pixels in the increasing direction of the pixel numbers as compared with those in the n−1 frame, are respectively displayed. In the sub-frames within the succeeding frames, display data of the respective colors are displayed in the same manner.

When such an animation picture is observed, the observer views the image while shifting his or her view point following the shift of the image. Therefore, the observer has to shift his or her view point six pixels for each frame in the shifting direction of the image, as indicated by arrow A in FIG. 5.

The reason that the observer shifts the view point while viewing the animation picture is because the observer tries to always maintain the shifting image at the same position on his or her retina. Consequently, the observer recognizes an image as shown in FIG. 6.

FIG. 6 is an explanatory drawing that shows a model of an animation picture that the observer recognizes. In the same manner as FIG. 5, in FIG. 6, the axis of ordinate is the time axis, and the axis of abscissa indicates a pixel on a certain line in the liquid crystal panel. The "results of observation" indicate an image that the observer actually recognizes, and they show that the closer the pitches of slanting lines, the darker the image recognized by the observer becomes. Here, arrow A corresponds to arrow A shown in FIG. 5, which indicates the shift of the observer's view point.

Within the n−1 frame, the red display data corresponding to pixel m to pixel m+7 is displayed in the red sub-frame, and from time t0 at which the red sub-frame starts and to time t1 at which the red sub-frame ends, since the view point is being shifted following the shift of the image, the red display data thus displayed is observed as if it were flowing in a direction opposite to the shifting direction of the view point (in a decreasing direction of the pixel numbers).

Then, from time t1 to time t2 at which the green sub-frame ends, since the view point has been further shifted, the green display data is observed as if it were further flowing in the decreasing direction of the pixel numbers as compared with the red display data. In the same manner, the blue display data is observed as if it were further flowing in the decreasing direction of the pixel numbers as compared with the green display data. As a result, as illustrated in FIG. 6, in the n−1 frame, the display data of the respective colors are observed as if they were being drawn in the decreasing direction of the pixel numbers, with an increasing influence as the sub-frames further proceed.

Within sub-frames in the following frames, the display data of the respective colors are observed as if they were being drawn in the decreasing direction of the pixel numbers.

In the case when such an animation picture is observed, since the respective display data of red, green and blue are separated in the time direction, the image observed has degradation in the image quality on its outline portion, as illustrated in "the results of observation" in FIG. 6. More specifically, even in the case of, for example, a white display, there are a portion having only a blue display, a portion having only blue and green displays, a portion having only a red display and a portion having only green and red displays, with the result that, in these portions, the image being observed is subjected to color aberration, and observed not as a desired white color, but as rainbow colors.

BRIEF SUMMARY OF THE INVENTION

The present invention has been devised to solve the above-mentioned problems, and its objective is to provide a liquid crystal display which has an arrangement in which, after display data of the respective colors have been displayed in each frame, a back-light is turned off for a predetermined time so as to narrow an area having color separations, thereby making it possible to make less conspicuous the phenomenon causing rainbow colors at the outline portion of an animation picture to be observed.

Moreover, another objective of the present invention is to provide a liquid crystal display in which a back-light is controlled so as to differentiate the order of display-data colors to be displayed in respective sub-frames within three consecutive frames so that display data of the three colors, that is, red, green and blue, are always provided at the outline portion, thereby making it possible to avoid the outline portion of an animation picture from being observed as rainbow colors.

A liquid crystal display in accordance with a first invention, which is provided with a liquid crystal panel having a plurality of liquid crystal pixel electrodes arranged in a matrix form, a back-light, placed on the rear face of a liquid crystal panel, for emitting a plurality of different color light rays sequentially color by color, and a back-light control circuit which emits the back-light sequentially color by color, and turns the back-light off for a predetermined time cyclically.

A liquid crystal display in accordance with a second invention, which is provided with a liquid crystal panel having a plurality of liquid crystal pixel electrodes arranged in a matrix form and a plurality of switching elements placed correspondingly to the respective liquid crystal pixel electrodes, a back-light, placed on the rear face of the liquid crystal panel, having a plurality of light sources respectively emitting different color light rays, and a light-source driving control circuit for controlling the driving processes of the respective light sources of the back-light by allowing each light source of the back-light to emit light rays sequentially color by color in synchronism with display data for each light source emitting color in one frame, applied to the respective liquid crystal pixel electrodes, while driving the switching elements to turn ON/OFF corresponding to the display data, so as to carry out a color display, wherein the light-source driving control circuit controls the driving processes of the respective light sources so as to allow them to successively repeat a turn-on period for turning on light sources color by color in turn, and a turn-off period for turning all the light sources off.

The first invention is provided with the back-light, placed on the rear face of the liquid crystal panel, for emitting, for example, three-color light rays of red, green and blue sequentially color by color. After the back-light has emitted the three-color light rays respectively, the back-light control circuit turns the back-light off for a predetermined time. In this manner, the one frame is provided with a period of time in which the back-light is turned off.

The second invention is provided with the light-source driving control circuit for controlling the driving processes of the three-color light sources, for example, of the back-light. Thus, the light-source driving control circuit drives the second-color light source after having driven the first-color light source, and then drives the third-color light source. Further, after having driven the third-color light source, it turns all the light-sources off.

Color separations, which take place at the outline portion of an animation picture, are generated during a period of time in which the light rays of the respective colors, red, green and blue, are emitted. Therefore, the time during which the back-light is turned off is provided so that an area having color separations can be narrowed; consequently, it is possible to make less conspicuous the phenomenon in which the outline portion of an animation picture is observed as rainbow colors.

A liquid crystal display in accordance with a third invention, which is provided with a liquid crystal panel having a plurality of liquid crystal pixel electrodes arranged in a matrix form, a back-light, placed on the rear face of the liquid crystal panel, for emitting at least three color light rays, and a back-light control circuit which allows the back-light to emit at least three color light rays sequentially color by color so as to differentiate the order of the light emissions within at least three consecutive frames.

A liquid crystal display in accordance with a fourth invention, which is provided with a liquid crystal panel having a plurality of liquid crystal pixel electrodes arranged in a matrix form and a plurality of switching elements placed correspondingly to the respective liquid crystal pixel electrodes, a back-light, placed on the rear face of the liquid crystal panel, having light sources of three colors, and a light-source driving control circuit for controlling the driving processes of the respective light sources of the back-light by allowing the back-light to emit light rays sequentially color by color in synchronism with three color display data in one frame, applied to the respective liquid crystal pixel electrodes, while driving the switching elements to turn ON/OFF corresponding to the display data, so as to carry out a color display, wherein the light-source driving control circuit controls the driving processes of the respective light sources so that, in each frame within consecutive three frames, among a first light-emitting order including the first, second and third colors in this order, a second light-emitting order including the second, third and first colors in this order, and a third light-emitting order including the third, first and second colors in this order, the respective light sources are driven in such a manner that the light-emitting order of each frame is different from the light-emitting orders of the other two frames.

In accordance with the third invention, the back-light that emits three color light rays of red, green and blue sequentially color by color is placed on the rear face of the liquid crystal panel. Further, the back-light control circuit controls the back-light in such a manner that the order of the light emissions of the three color light rays from the back-light is different in each of three consecutive frames.

In accordance with the fourth invention, the light-source driving control circuit controls the driving processes of the three-color light sources of the back-light. Here, the light-source driving control circuit assigns any one of the first light-emitting order including the first, second and third colors in this order, the second light-emitting order including the second, third and first colors in this order and the third light-emitting order including the third, first and second colors in this order to each frame within three consecutive frames in a manner so as not to overlap with each other, and the respective light sources are driven in accordance with the order of light emissions.

In three consecutive frames, this arrangement makes it possible to avoid the orders of the light-emissions of the respective colors from coinciding with each other, with the result that the three-color display data of red, green and blue are always allowed to exist at the outline portion of an animation picture. Therefore, since no color separations take place, it is possible to prevent the outline portion of an animation picture from being observed as a rainbow colored portion.

Additionally, in this case also, since the observer views the animation picture while shifting his or her view point following the shift of the animation picture, the later the sub-frame in each frame, the greater the influence of the phenomenon in which the display data is observed as if it were drawn in a direction opposite to the shifting direction of the animation picture. Therefore, there is degradation (fuzziness).due to the difference in brightness in the animation picture. In other words, during a period of three consecutive frames, the three-color display data of red, green and blue are always allowed to exist in the outline portion of the animation picture; however, since there is a difference in the lengths of the time of existence (light emission time), a monochrome display consisting of bright white and dark white is observed in an area having the degradation in the image quality, for example, in a white display. However, as compared with the case in which rainbow colors are observed, this case is more advantageous since the degradation in the image quality is less conspicuous.

In a liquid crystal display in accordance with a fifth invention that relates to the liquid crystal display of the first invention, the back-light control circuit allows the plurality of different color light rays of the back-light to be emitted sequentially color by color so as not to have the same light-emitting order of colors in the consecutive plurality of frames.

In a liquid crystal display in accordance with the sixth invention, which is provided with a liquid crystal panel having a plurality of liquid crystal pixel electrodes arranged in a matrix form and a plurality of switching elements placed correspondingly to the respective liquid crystal pixel electrodes, a back-light, placed on the rear face of the liquid crystal panel, having light sources of three colors, and a light-source driving control circuit for controlling the driving processes of the respective light sources of the back-light by allowing the back-light to emit light rays sequentially color by color in synchronism with three color display data in one frame, applied to the respective liquid crystal pixel electrodes, while driving the switching elements to turn ON/OFF corresponding to the display data, so as to carry out a color display, wherein the light-source driving control circuit controls the driving processes of the respective light sources so that, in each frame within consecutive three frames, among a first light-emitting order including the first, second and third colors in this order, a second light-emitting order including the second, third and first colors in this order, and a third light-emitting order including the third, first and second colors in this order, the respective light sources are driven in such a manner that the light-emitting order of each frame is different from the light-emitting orders of the other two frames, and the driving processes of the respective light sources are controlled so that, in each of the frames, after the period for driving the third light source, a turn-off period for turning all the light sources off is provided.

In accordance with the fifth invention, the back-light for emitting the three-color light rays sequentially color by color is placed on the rear face of the liquid crystal panel. After the back-light has emitted the three-color light rays respectively, the back-light control circuit turns the back-light off for a predetermined time. In this manner, the period of time for turning the back-light off is provided in each frame. Moreover, the back-light control circuit controls the back-light so that the orders of the light-emissions of the respective colors are different from each other in three consecutive frames.

In accordance with the sixth invention, the light-source driving control circuit for controlling the driving processes of the three-color light sources of the back-light is provided. Here, the light-source driving control circuit assigns any one of the first light-emitting order including the first, second and third colors in this order, the second light-emitting order including the second, third and first colors in this order and the third light-emitting order including the third, first and second colors in this order to each frame within three consecutive frames in a manner so as not to overlap with each other, and the respective light sources are driven in accordance with the order of light emissions. Moreover, the light-source driving control circuit turns all the light sources off, after having driven the third light source, in each frame.

In three consecutive frames, this arrangement makes it possible to avoid the orders of the light-emissions of the respective colors from coinciding with each other, with the result that the three-color display data of red, green and blue are always allowed to exist at the outline portion of an animation picture. Therefore, since no color separations take place, it is possible to prevent the outline portion of an animation picture from being observed as a rainbow colored portion. Moreover, since the period of time for turning the back-light off is provided in each frame, it is possible to minimize the difference in the light-emission times of the three color light rays, and consequently to narrow the area having degradation in the image quality due to differences in brightness.

A liquid crystal display in accordance with a seventh invention that relates to the liquid crystal display of the second or sixth invention is characterized in that the turn-off period is set to be approximately a ¼ frame time.

In accordance with the seventh invention, after the back-light has emitted the three-color light rays sequentially color by color, the period during which the back-light is turned off is set to be approximately ¼ frame time. Here, the ¼ frame time refers to a ¼ of a period of time required for displaying one frame. In this case, the light-emitting time of the back-light is ¾ frame time.

Color separations, which occur at the outline portion of an animation picture, are generated while the respective color-light rays of red, green and blue are being emitted. Since the turn-off time of the back-light corresponding to ¼ frame time is provided in this manner, it is possible to narrow the area having color separations to ¾, and consequently to make less conspicuous degradation in the image quality occurring in the outline portion of the animation picture.

In a liquid crystal display in accordance with an eighth invention that relates to the liquid crystal display of the second or sixth invention, the turn-off period is set to be approximately ½ frame time.

In accordance with the eighth invention, after the back-light has emitted the three-color light rays sequentially color by color, the period during which the back-light is turned off is set to be approximately ½ frame time. Here, the ½ frame time refers to a ½ of a period of time required for displaying one frame. In this case, the light-emitting time of the back-light is ½ frame time.

As compared with the seventh invention, since the turn-off time of the back-light is made longer so that it is possible to further narrow the area having color separations, and consequently to make less conspicuous degradation in the image quality occurring at the outline portion of a moving image.

The above and further objects and features of the invention will more fully be apparent from the following detailed description with accompanying drawings.

BRIEF DESCRIPTION OF THE SEVERAL VIEWS OF THE DRAWING

FIGS. 10A to 10C are time charts that show display controlling processes in the liquid crystal display of Embodiment 1 of the present invention;

FIGS. 14A to 14C are time charts that show display controlling processes in the liquid crystal display of Embodiment 3 of the present invention;

FIGS. 16 to 16C are time charts that show display controlling processes in the liquid crystal display of Embodiment 4 of the present invention.

DETAILED DESCRIPTION OF THE INVENTION (Embodiment 1)

Figure 1:
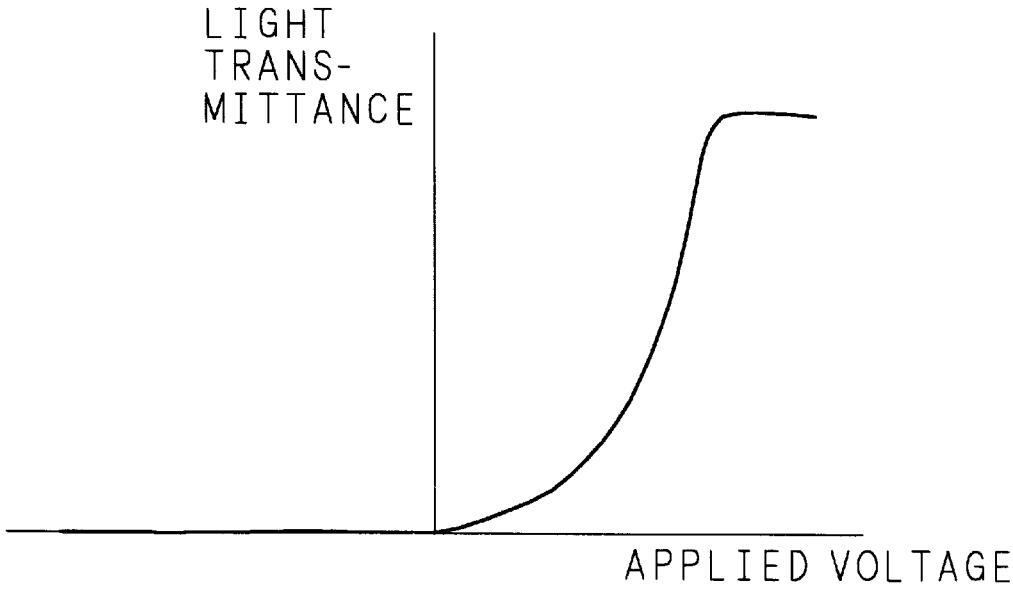
FIG. 1 PRIOR ART
FIG. 1 is a graph that shows the electro-optical characteristics of a ferroelectric liquid crystal.
Figure 2:
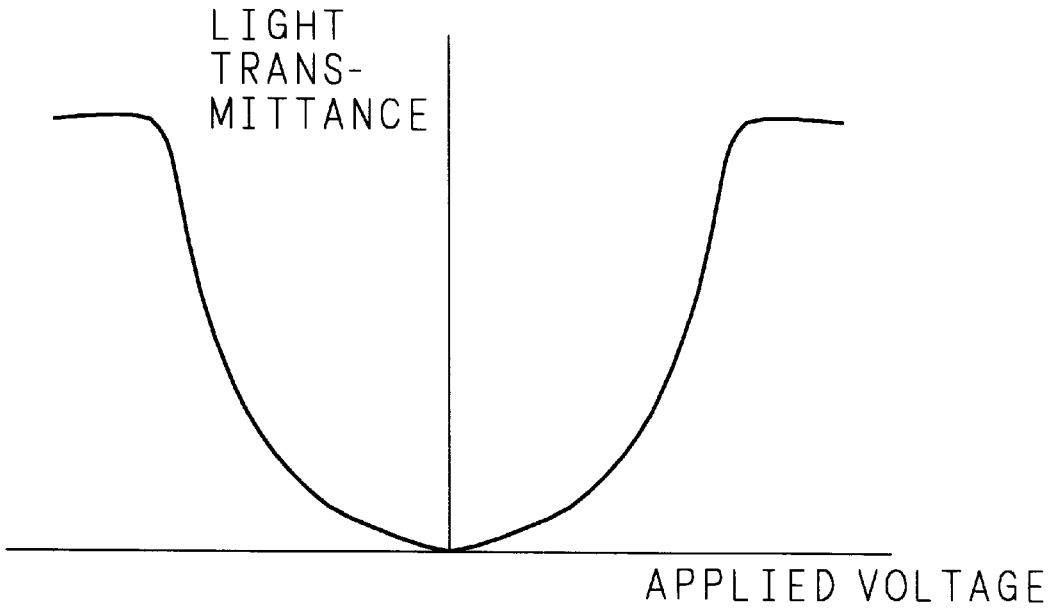
FIG. 2 PRIOR ART
FIG. 2 is a graph that shows the electro-optical characteristics of an anti-ferroelectric liquid crystal.
Figure 3:
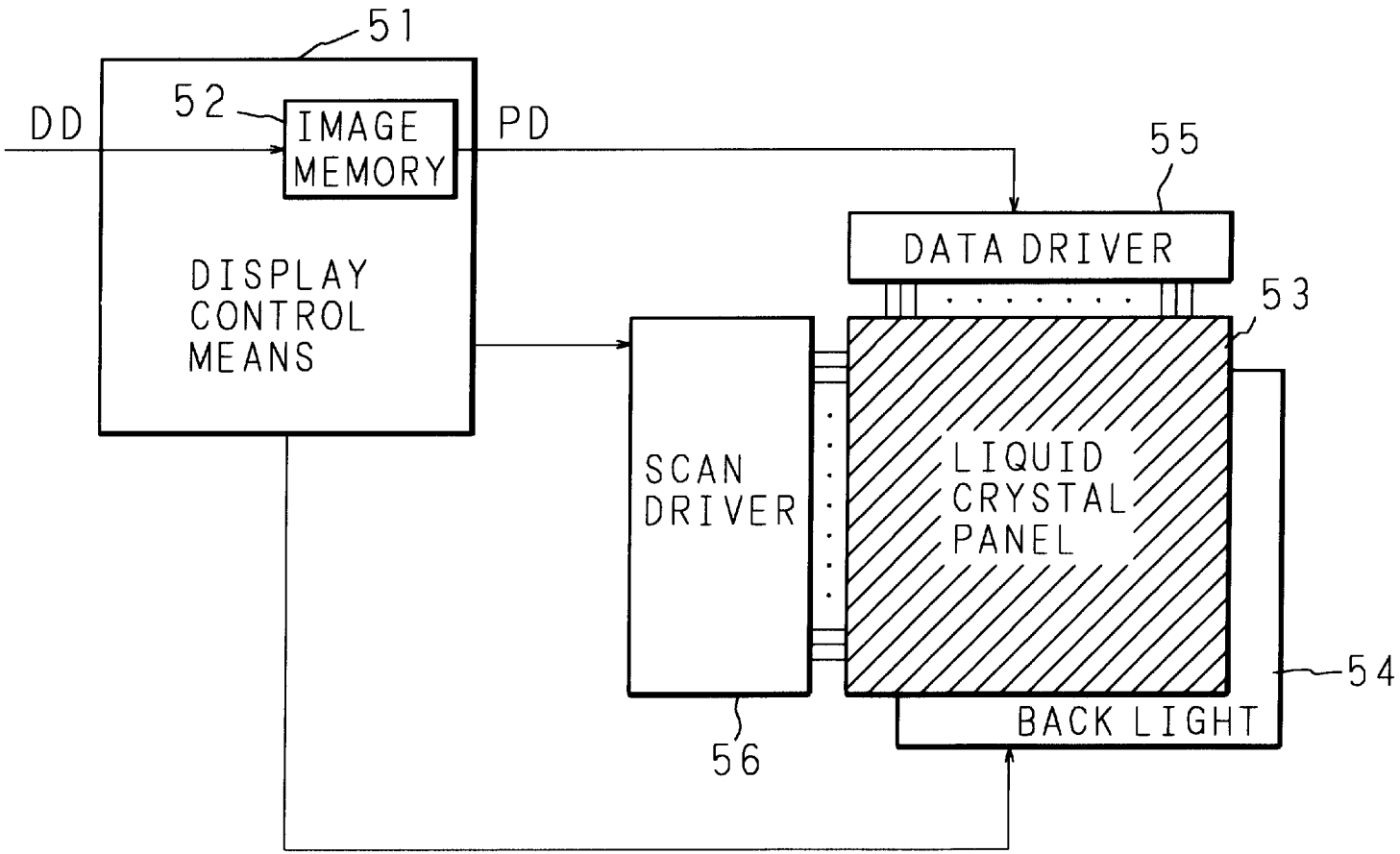
FIG. 3 PRIOR ART
FIG. 3 is a block diagram that shows one structural example of a conventional liquid crystal display.
Figure 4:
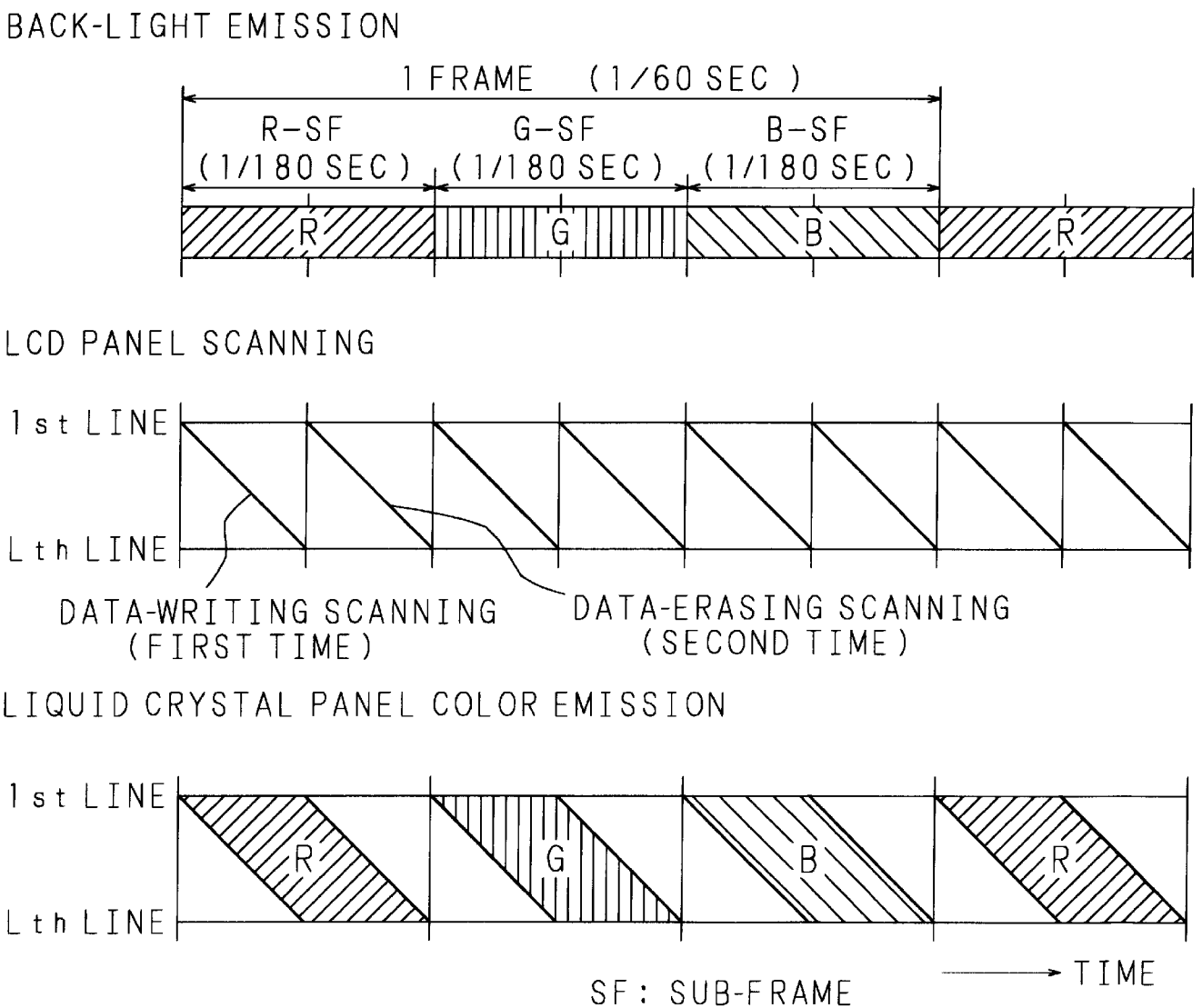
FIGS. 4A to 4C are time charts that show one example of display control processes in the conventional liquid crystal display.
Figure 5:
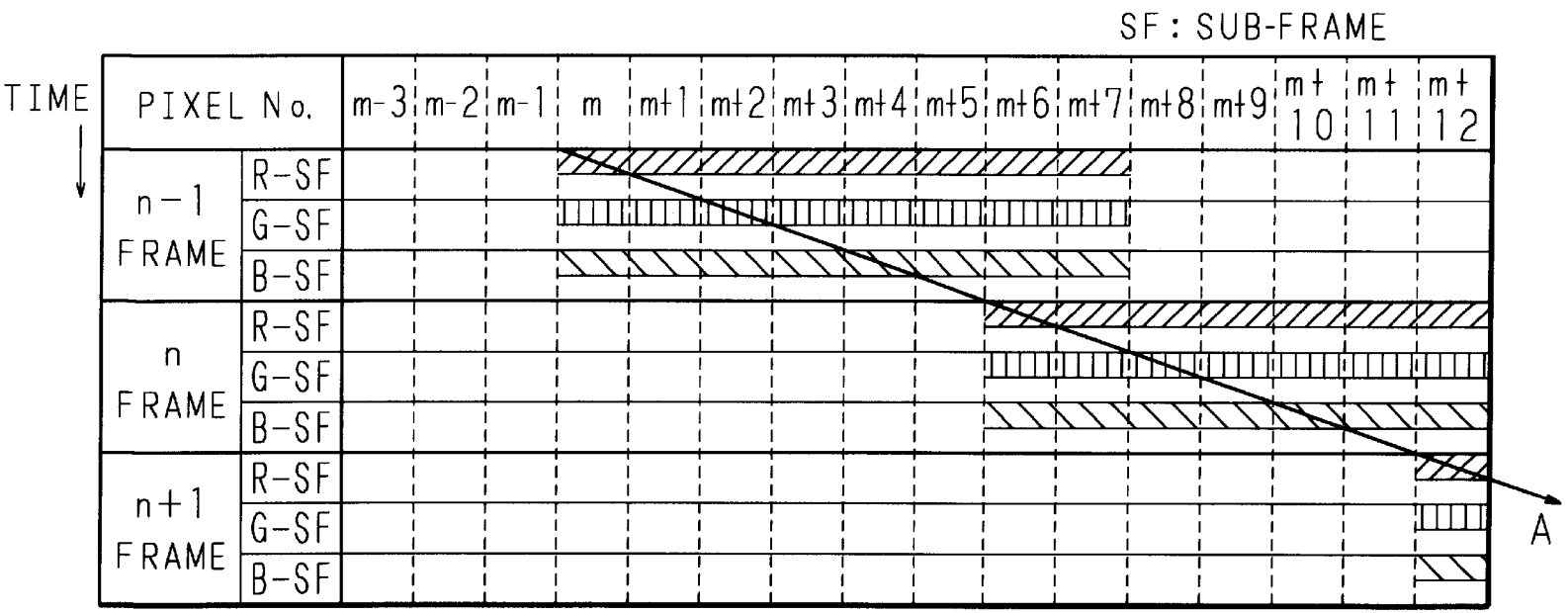
FIG. 5 PRIOR ART
FIG. 5 is an explanatory drawing that shows a model of an animation picture displayed on a liquid crystal panel by the conventional liquid crystal display.
Figure 6:
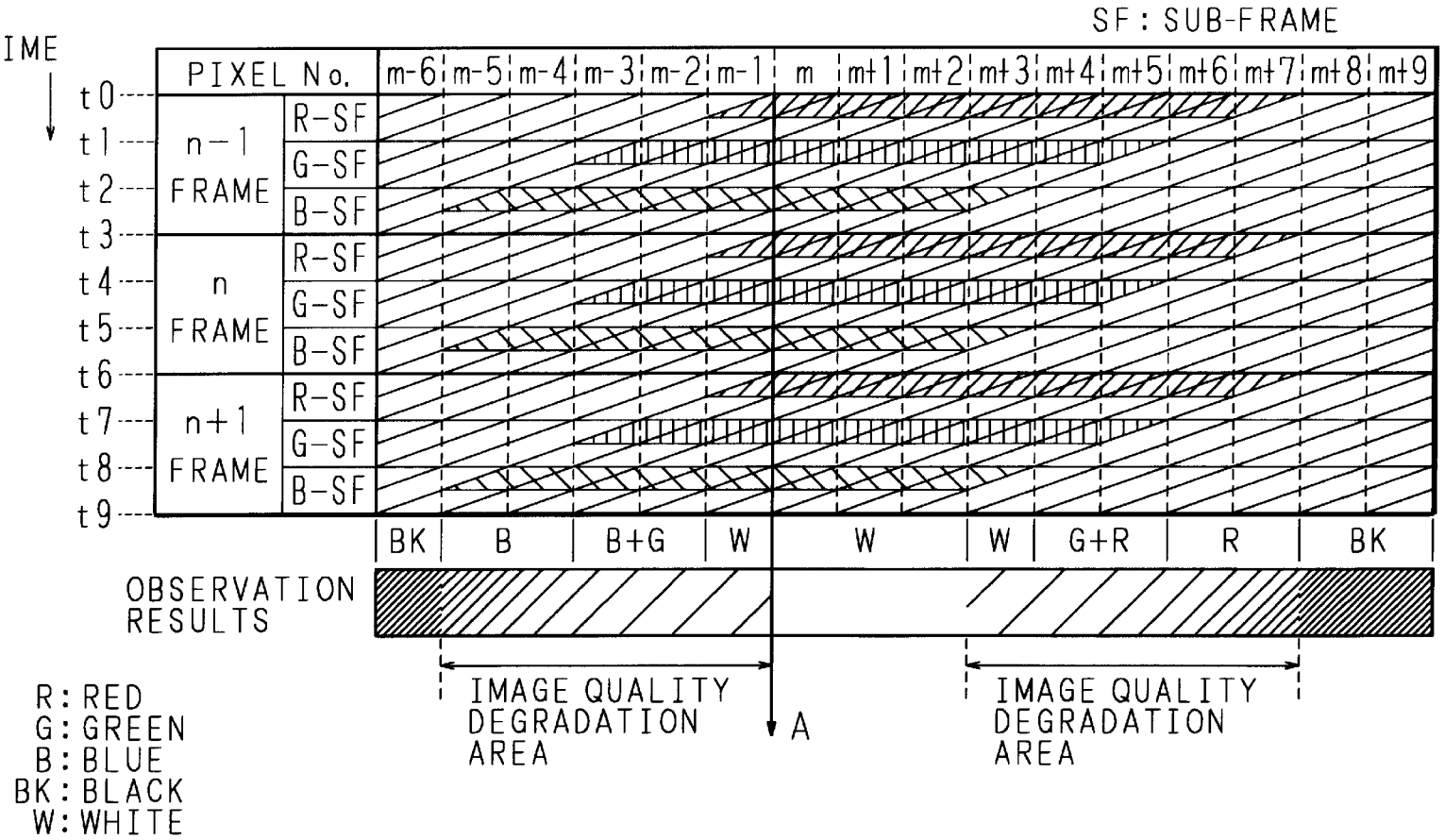
FIG. 6 PRIOR ART
FIG. 6 is an explanatory drawing that shows a model of an animation picture recognized by an observer on the liquid crystal panel of the conventional liquid crystal display.
Figure 7:
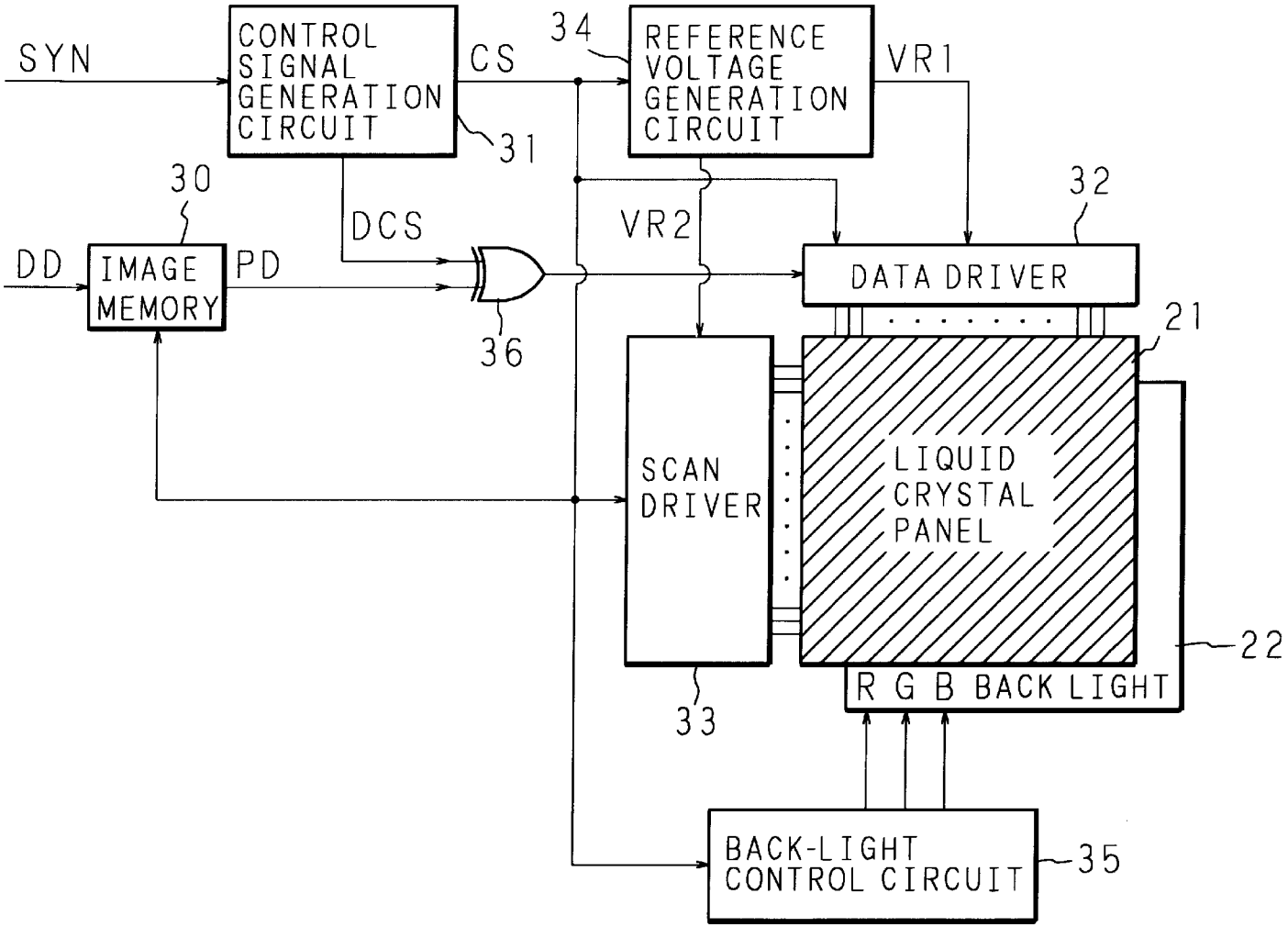
FIG. 7 is a block diagram that shows a circuit construction of a liquid crystal display in accordance with Embodiment 1 of the present invention.
Figure 8:
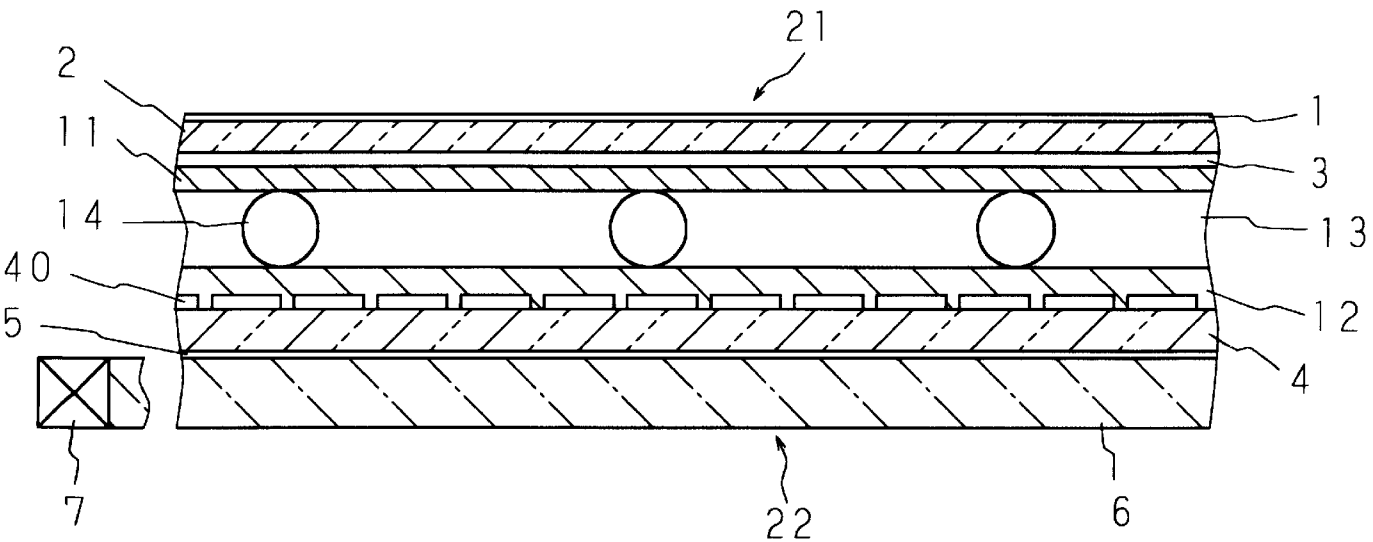
FIG. 8 is a schematic cross-sectional view of a liquid crystal panel and a back-light that are provided in the liquid crystal display in accordance with Embodiment 1 of the present invention.

FIG. 7 is a block diagram that shows the construction of a liquid crystal display in accordance with Embodiment 1 of the present invention; FIG. 8 is a schematic cross-sectional view showing the liquid crystal panel and the back-light thereof; and FIG. 9 is a schematic perspective view showing an example of the entire structure of the liquid crystal display.

In FIG. 7, reference numerals 21 and 22 respectively show a liquid crystal panel and a back-light the cross-sectional views of which are shown in FIG. 8. As illustrated in FIG. 8, the back-light is constituted by an LED array 7 emitting light rays of the respective colors, red, green and blue, and a light-quiding and diffusing plate 6.

Figure 9:
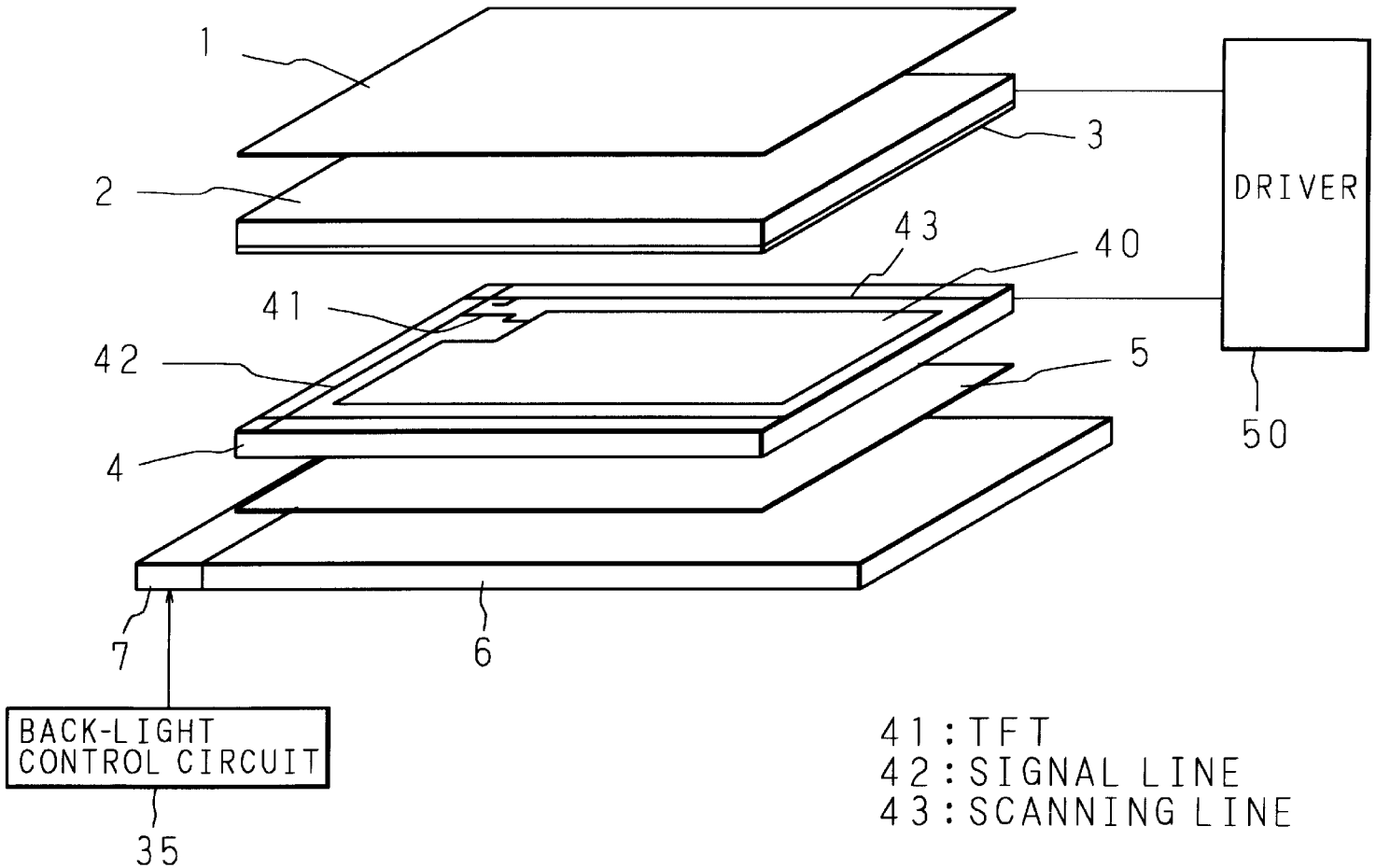
FIG. 9 is a schematic perspective view that shows an example of the entire structure of the liquid crystal display of Embodiment 1 of the present invention.

As illustrated in FIGS. 8 and 9, the liquid crystal panel 21 is constituted by the following layers that are stacked from the upper layer (surface) side to the lower layer (rear face) side in this order: a polarizing film 1, a glass substrate 2, a common electrode 3, a glass substrate 4, and a polarizing film 5, and liquid crystal pixel electrodes (pixel electrodes) 40 arranged on the surface of the glass substrate 4 on the common electrode 3 side in a matrix form.

A driver 50, which is constituted by a data driver 32, a scan driver 33, etc. that will be described later, is connected between the common electrode 3 and the pixel electrodes 40. The data driver 32 is connected to a TFT 41 through a signal line 42, and the scan driver 33 is connected to the TFT 41 through a scanning line 43. The TFT 41 is ON-OFF controlled by the data driver 32 and the scan driver 33. Moreover, the individual pixel electrodes 40 are ON-OFF controlled by the TFT 41. Consequently, the intensity of the transmitting light of each pixel is controlled by a signal from the data driver 32 given through the signal line 42 and the TFT 41.

An alignment film 12 is placed on the upper surface of the pixel electrodes 40 on the glass substrate 4 and an alignment film 11 is placed on the bottom face of the common electrode 3; thus, a liquid crystal is injected between the alignment films 11 and 12 to form a liquid crystal layer 13. Here, reference number 14 indicates spacers for maintaining the layer thickness of the liquid crystal layer 13.

A back-light 22 is placed on the lower layer (rear face) side of the liquid crystal panel 21, and provided with an LED array 7 that faces one end face of the light-guiding and diffusing plate 6 that constitutes a light-emitting area. The light-guiding and diffusing plate 6 guiding light emitted from the respective LEDs of the LED array 7 through its entire surface and diffuses it toward the upper face, thereby serving as the light-emitting area.

Here, an explanation will be given of a specific example of the liquid crystal display of the present invention.

First, the liquid crystal panel 21 indicated by FIGS. 8 and 9 was formed as follows: Individual pixel electrodes 40 are arranged with pitches 0.24 mm×0.24 mm so as to form a matrix form having pixels of 1024×768 with a diagonal length of 12. 1 inches; thus, a TFT substrate was formed. After this TFT substrate and a glass substrate 2 having a common electrode 3 had been washed, polyimide was coated to these by using a spin coater, and baked for one hour at 200° C. to form alignment films 11 and 12 made of polyimide films each having approximately 200 Å.

Moreover, these alignment films 11 and 12 were rubbed with a cloth made of rayon, and lapped with a gap being maintained between them by spacers made of silica having an average particle size of 1.6 $\mu$m; thus, an empty panel was formed. A ferroelectric liquid crystal mainly composed of naphthalene-series liquid crystal was sealed between the alignment films 11 and 12 of this empty panel to form a liquid crystal layer 13. The panel thus manufactured was sandwiched by two polarizing films 1 and 5 maintained in a cross-Nicol state so that a dark state could be formed when the ferroelectric liquid crystal molecules tilted to one side; thus, a liquid crystal panel 21 was formed.

This liquid crystal panel 21 was lapped with a back-light 22 capable of emitting red, green and blue light rays sequentially color by color. The light-emitting timing and the light-emitting colors of the back-light 22 were controlled in synchronism with the data write/erase scanning processes of the liquid crystal panel 21.

Next, referring to FIGS. 7 through 9, an explanation will be given of the circuit construction of a liquid crystal display in accordance with Embodiment 1 of the present invention.

In FIG. 7, reference numeral 30 represents an image memory to which display data DD from, for example, an external personal computer is inputted and in which the inputted display data DD is stored. Reference numeral 31 is a control signal generation circuit to which a synchronous signal SYN is inputted from the same personal computer and in which a control signal CS and a data conversion control signal DCS are generated. Pixel data PD is outputted from the image memory 30 to a data conversion circuit 36, and the data conversion control signal DCS is also outputted from the control signal generation circuit 31 thereto. The data conversion circuit 36 generates pixel data PD or reverse pixel data #PD obtained by inverting the pixel data PD, in accordance with the data conversion control signal DCS.

Moreover, from the control signal generation circuit 31, the control signal CS is outputted to a reference voltage generation circuit 34, the data driver 32, the scan driver 33 and the back-light control circuit 35, respectively. The reference voltage generation circuit 34, which generates reference voltages VR1 and VR2, outputs the resulting reference voltages VR1 and reference voltage VR2 respectively to the data driver 32 and the scan driver 33. The data driver 32 outputs a signal to a signal line 42 of pixel electrodes 40 based upon the pixel data PD or the reverse pixel data #PD that has been received from the image memory 30 through the data conversion circuit 36. In synchronism with the output of this signal, the scan driver 33 scans scanning lines 43 of the pixel electrodes 40 line by line in succession. Moreover, the back-light control circuit 35 applies a driving voltage to the back-light 22 so that LEDs having respective red, green and blue colors in the LED array 7 of the back-light 22 are allowed to emit light rays sequentially color by color.

Next, an explanation will be given of the operations of the liquid crystal display in accordance with the present invention.

To the image memory 30, display data DD of the respective colors of red, green and blue to be displayed on the liquid crystal panel 21 is given from the personal computer. After having temporarily memorized the display data DD, the image memory 30 outputs pixel data PD that is data corresponding to each pixel unit upon receipt of the control signal CS outputted from the control signal generation circuit 31. When the display data DD is given to the image memory 30, the synchronous signal SYN is given to the control signal generation circuit 31, and the control signal generation circuit 31 generates the control signal CS and the data conversion control signal DCS, and outputs them in the case when the synchronous signal SYN is inputted. The pixel data PD, outputted from the image memory 30, is given to the data conversion circuit 36.

In the case when the data conversion control signal DCS outputted from the control signal generation circuit 31 has the Low level, the data conversion circuit 36 allows the pixel data PD to pass as it is, and in the case when the data conversion control signal DCS has the High level, it generates the reverse pixel data #PD and outputs this. Therefore, in the control signal generation circuit 31, at the time of data-write scanning, the data conversion control signal DCS is set to be the Low level, and at the time of data-erase scanning, the data conversion control signal DCS is set to be the High level.

The control signal CS, generated in the control signal generation circuit 31, is given to the data driver 32, the scan driver 33, the reference voltage generation circuit 34 and the back light control circuit 35, respectively.

Upon receipt of the control signal CS, the reference voltage generation circuit 34 generates the reference voltages VR1 and VR2, and outputs the resulting reference voltage VR1 and reference voltage VR2 to the data driver 32 and the scan driver 33, respectively.

Upon receipt of the control signal CS, the data driver 32 outputs a signal to the signal lines 42 of the pixel electrodes 40 based upon the pixel data PD or the reverse pixel data #PD outputted from the image memory 30 through the data conversion circuit 36. Upon receipt of the control signal CS, the scan driver 33 scans the scanning lines 43 of the pixel electrodes 40 line by line in succession.

In accordance with the output of the signal from the data driver 32 and the scanning of the scan driver 33, the TFT 41 is driven, a voltage is applied to the pixel electrodes 40, and the intensity of the transmitting light of the pixels is controlled.

Upon receipt of the control signal CS, the back-light control circuit 35 applies a driving voltage to the back-light 22 so as to allow the LEDs having the respective colors of red, green and blue in the LED array 7 of the back-light 22 to emit light sequentially color by color.

Referring to time charts in FIG. 10, an explanation will be given of display controlling processes in the liquid crystal display in accordance with Embodiment 1 of the present invention. FIG. 10A shows the light-emitting timing of the LEDs of the respective colors of the back-light 22, FIG. 10B shows the scanning timing of respective lines in the liquid crystal panel 21, and FIG. 10C shows color-emitting states of the liquid crystal panel 21.

As shown in FIG. 10A, the LEDs in the back-light 22 are allowed to emit light rays successively in the order of red, green and blue, and in synchronism with these light emissions, the respective pixels of the liquid crystal panel 21 are switched on a line basis so as to carry out a display. In Embodiment 1, a display of 60 frames per second is carried out. Therefore, one frame period is a 1/60 second, and this one frame is further divided into four sub-frames each having a 1/240 second.

Here, in the respective sub-frames from the first to third, the LEDs of red, green and blue are respectively allowed to emit light rays. Then, in the fourth sub-frame, the back-light 22 is turned off.

As shown in FIG. 10B, with respect to the liquid crystal panel 21, data scanning processes are carried out twice in each of the red, green and blue sub-frames. Here, the timing adjustments are made so that the timing of the start (timing to the first line) of the first scanning (data-write scanning) is coincident with the timing of the start of each sub-frame, and so that the timing of the end (timing to the last line) of the second scanning (data-erase scanning) is coincident with the timing of the end of each sub-frame.

Upon carrying out the data-write scanning, a voltage corresponding to the pixel data PD is applied to each pixel in the liquid crystal panel 21 so that the adjustment of the transmittance is carried out. Thus, it is possible to perform a full-color display. Moreover, upon carrying out the data-erase scanning, the same voltage as that of the data-write scanning, with the reversed polarity is applied to each pixel in the liquid crystal panel 21 so that the display of each pixel in the liquid crystal panel 21 is erased, and the application of a DC component to the liquid crystal is prevented.

Figure 11:
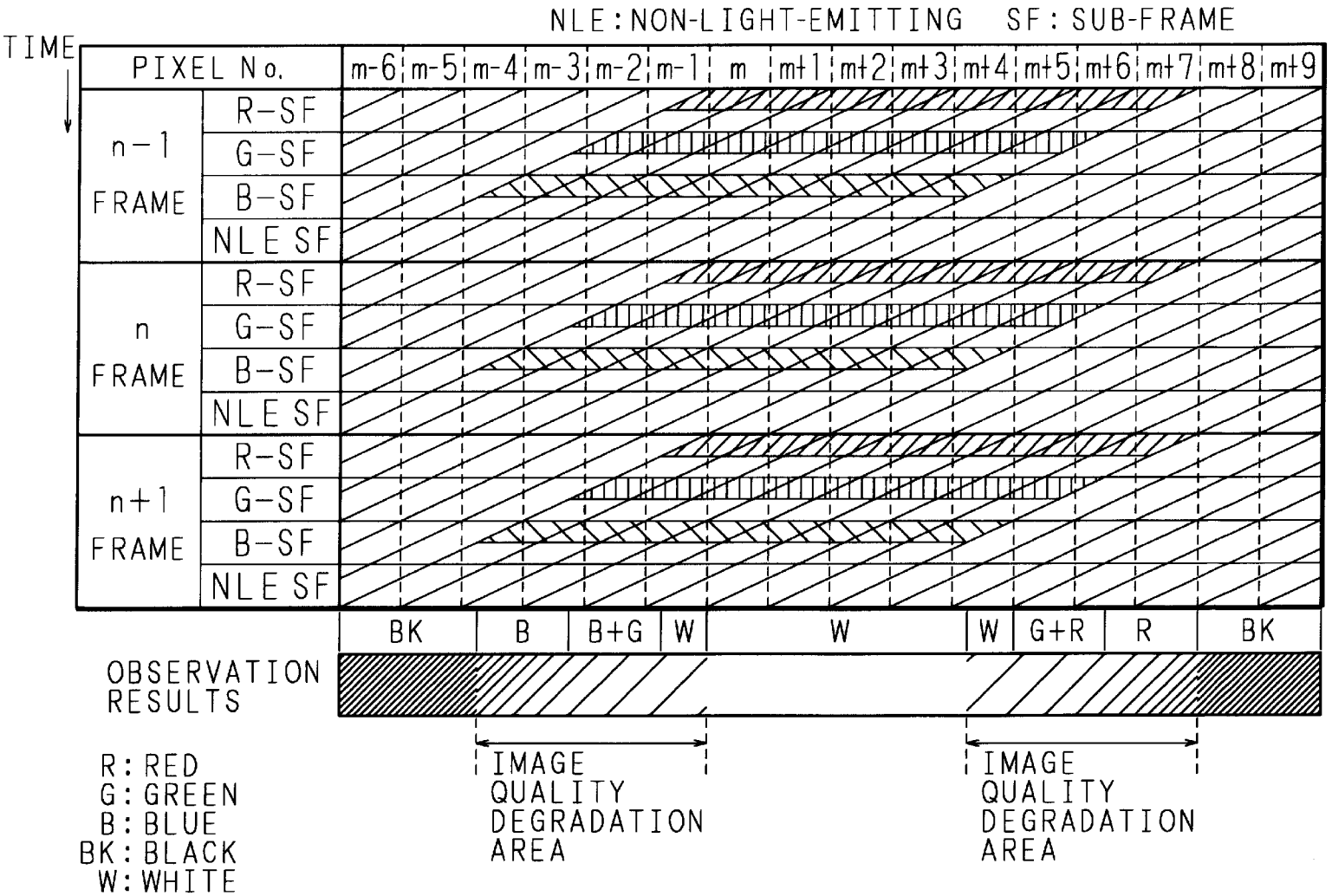
FIG. 11 is an explanatory drawing that shows a model of an animation picture recognized by an observer, on the liquid crystal panel of the liquid crystal display of Embodiment 1 of the present invention.

FIG. 11 is an explanatory drawing that shows a model of an animation picture recognized by an observer, on the liquid crystal panel of the liquid crystal display in accordance with Embodiment 1 of the present invention.

As described above, after the LEDs of red, green and blue have emitted light rays in the respective sub-frames, the back-light 22 is turned off for a ¼ frame time (non-light-emitting SF in FIG. 11), with the result that, as shown in "the results of observation" in FIG. 11, the area having color separations at the outline portion of an animation picture (an image-quality degradation area in FIG. 11) can be narrowed to ¾. Therefore, it is possible to make less conspicuous the phenomenon causing rainbow colors at the outline portion of an animation picture.

(Embodiment 2)

Figure 12:
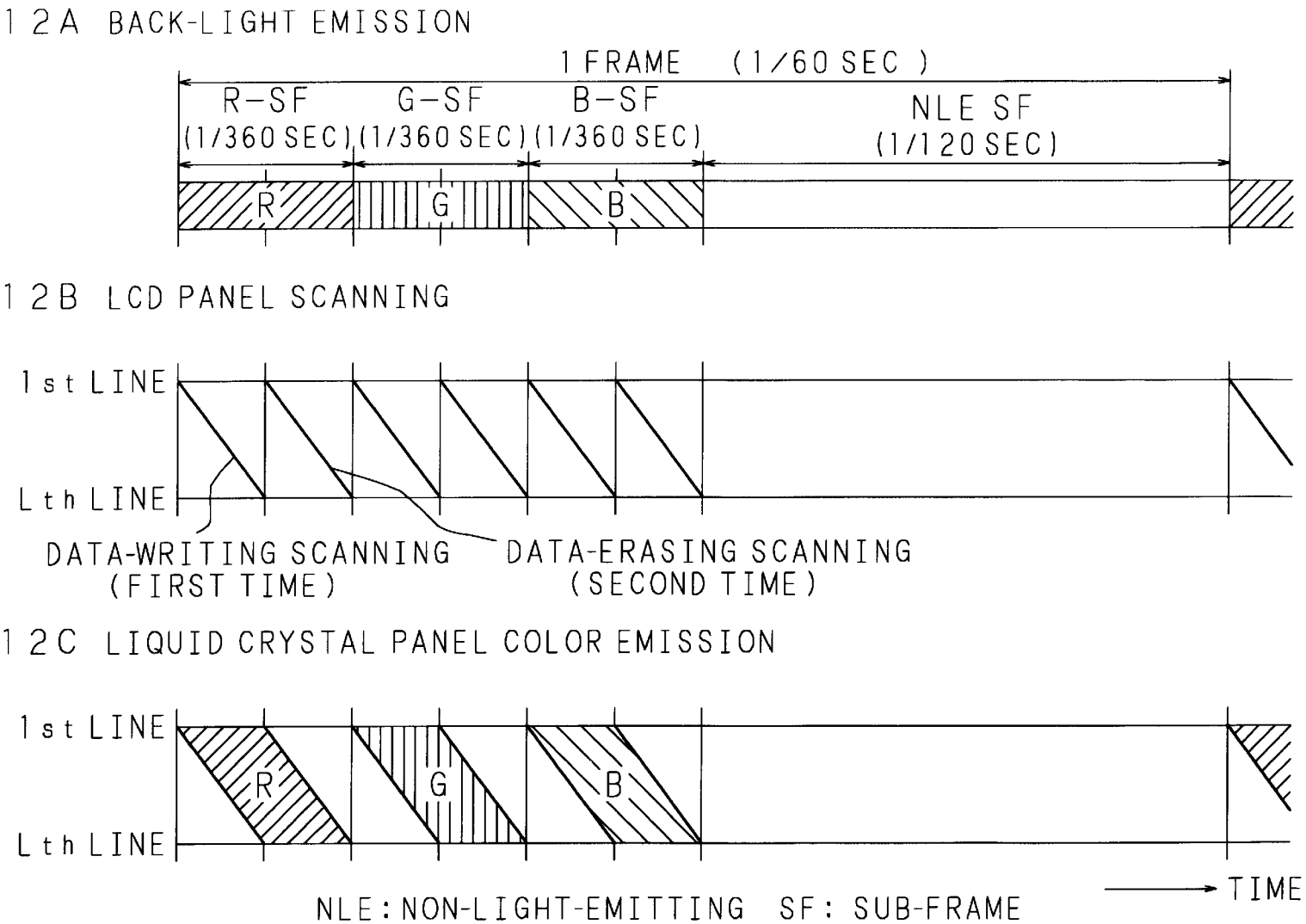
FIGS. 12A to 12C are time charts that show display controlling processes in the liquid crystal display of Embodiment 2 of the present invention.

FIG. 12 is a time chart showing display controlling processes in a liquid crystal display in accordance with Embodiment 2 of the present invention.

FIG. 12A shows light-emitting timing of LEDs of respective colors in the back-light 22, FIG. 12B shows scanning timing of respective lines in the liquid crystal panel 21, and FIG. 12C shows light-emitting states of the liquid crystal panel 21.

As illustrated in FIG. 12A, the LEDs in the back-light 22 are allowed to emit light rays successively in the order of red, green and blue, and in synchronism with these light emissions, the respective pixels of the liquid crystal panel 21 are switched on a line basis so as to carry out a display. In the same manner as Embodiment 1, in Embodiment 2 also, a display of 60 frames per second is carried out. Therefore, one frame period is a 1/60 second, and this one frame is further divided into six sub-frames each having a 1/360 second.

In the respective sub-frames of the first to third, the LEDs of red, green and blue are respectively allowed to emit light rays. Here, in the sub-frames of the fourth to sixth, the back-light 22 is turned off.

As shown in FIG. 12B, with respect to the liquid crystal panel 21, data scanning processes are carried out twice in each of the red, green and blue sub-frames. Here, the timing adjustments are made so that the timing of the start (timing to the first line) of the first scanning (data-write scanning) is coincident with the timing of the start of each sub-frame, and so that the timing of the end (timing to the last line) of the second scanning (data-erase scanning) is coincident with the timing of the end of each sub-frame.

Upon carrying out the data-write scanning, a voltage corresponding to the pixel data PD is applied to each pixel in the liquid crystal panel 21 so that the adjustment of the transmittance is carried out. Thus, it is possible to perform a full-color display. Moreover, upon carrying out the data-erase scanning, the same voltage as that of the data-write scanning, with the reversed polarity is applied to each pixel in the liquid crystal panel 21 so that the display of each pixel in the liquid crystal panel 21 is erased, and the application of a DC component to the liquid crystal is prevented.

Here, the circuit construction and the structures of the liquid crystal panel and back-light of the liquid crystal display in accordance with Embodiment 2 of the present invention are the same as those of Embodiment 1; therefore, the description thereof is omitted.

Figure 13:
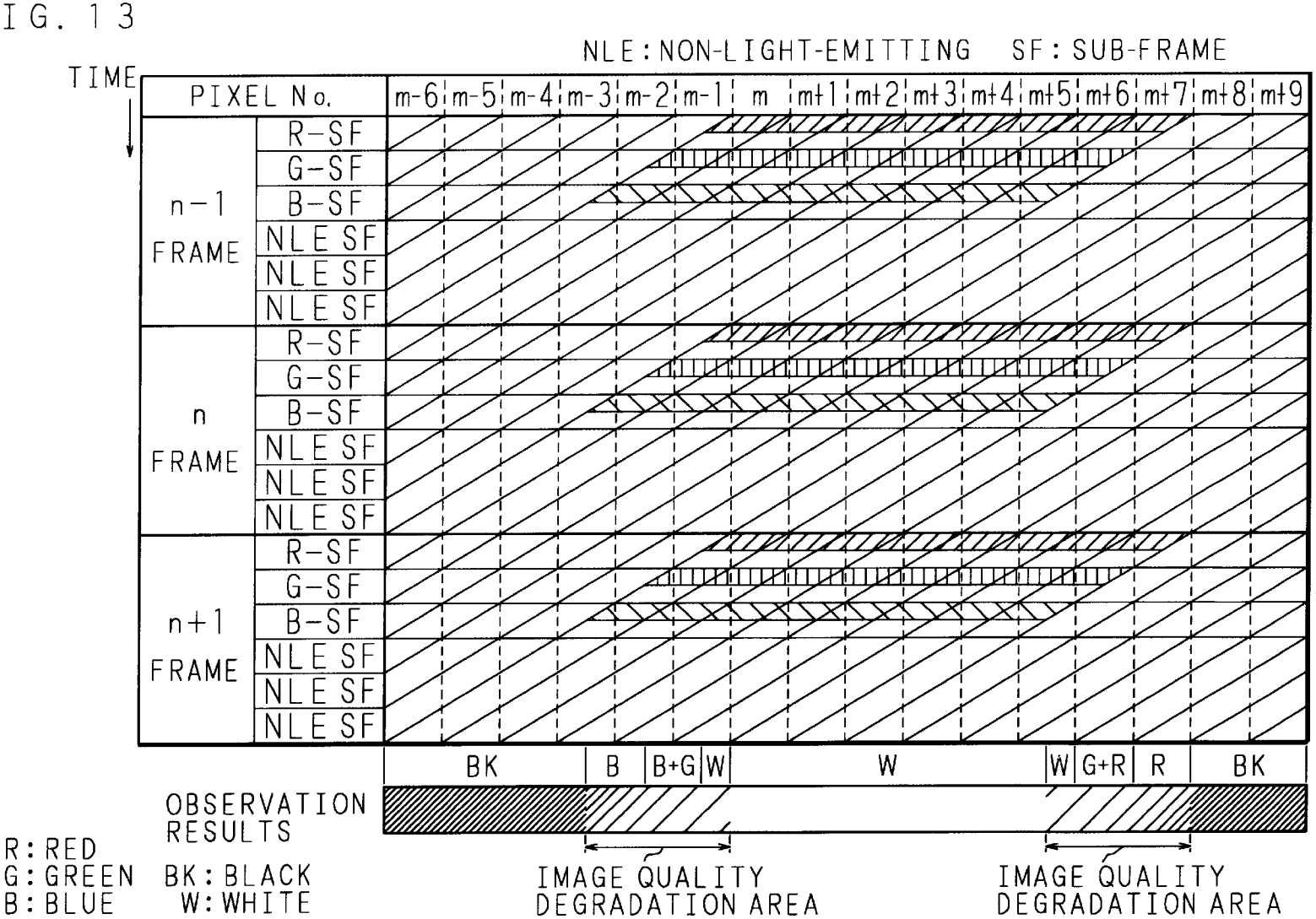
FIG. 13 is an explanatory drawing that shows a model of an animation picture recognized by an observer, on the liquid crystal panel of the liquid crystal display of Embodiment 2 of the present invention.

FIG. 13 is an explanatory drawing that shows a model of an animation picture recognized by an observer, on the liquid crystal panel of the liquid crystal display in accordance with Embodiment 2 of the present invention. This model also exemplifies a case in which a white image is displayed on the black background.

As described above, after the LEDs of red, green and blue have emitted light rays in the respective sub-frames, the back-light 22 is turned off for a ½ frame time (=⅙ frame time×3) (non-light-emitting SF in FIG. 13), with the result that, as shown in "the results of observation" in FIG. 13, the area having color separations at the outline portion of an animation picture (an image-quality degradation area in FIG. 13) can be narrowed to ½. Therefore, it is possible to make still less conspicuous the phenomenon causing rainbow colors at the outline portion of a moving image.

In the above explanations, the emitting light colors are three colors, red, green and blue, but the number of emitting light colors is not limited to three colors.

(Embodiment 3)

FIG. 14 is a time chart showing display controlling processes in a liquid crystal display in accordance with Embodiment 3 of the present invention.

FIG. 14A shows light-emitting timing of LEDs of respective red, green and blue colors in the back-light 22, FIG. 14B shows scanning timing of respective lines in the liquid crystal panel 21, and FIG. 14C shows light-emitting states of the liquid crystal panel 21.

As illustrated in FIG. 14A, in the same manner as Embodiment 1, in Embodiment 3 also, a display of 60 frames per second is carried out. Therefore, one frame period is a 1/60 second, and this one frame is further divided into three sub-frames each having a 1/180 second. Here, the back-light control circuit 35 controls the back-light 22 so that light emissions are carried out in the respective sub-frames within each frame in the following order.

First, in the first frame, the red LED emits light in the first sub-frame, the green LED emits light in the second sub-frame, and the blue LED emits light in the third sub-frame.

Next, in the second frame, the green LED emits light in the first sub-frame, the blue LED emits light in the second sub-frame, and the red LED emits light in the third sub-frame.

Then, in the third frame, the blue LED emits light in the first sub-frame, the red LED emits light in the second sub-frame, and the green LED emits light in the third sub-frame.

In this manner, the back-light control circuit 35 controls the back-light 22 so that, in consecutive three frames, the orders of light emissions of the respective colors carried out by the LEDs in the respective sub-frames are not coincident with each other.

As shown in FIG. 14B, with respect to the liquid crystal panel 21, data scanning processes are carried out twice in each of the red, green and blue sub-frames. Here, the timing adjustments are made so that the timing of the start (timing to the first line) of the first scanning (data-write scanning) is coincident with the timing of the start of each sub-frame, and so that the timing of the end (timing to the last line) of the second scanning (data-erase scanning) is coincident with the timing of the end of each sub-frame.

Upon carrying out the data-write scanning, a voltage corresponding to the pixel data PD is applied to each pixel in the liquid crystal panel 21 so that the adjustment of the transmittance is carried out. Thus, it is possible to perform a full-color display. Moreover, upon carrying out the data-erase scanning, the same voltage as that of the data-write scanning, with the reversed polarity is applied to each pixel in the liquid crystal panel 21 so that the display of each pixel in the liquid crystal panel 21 is erased, and the application of a DC component to the liquid crystal is prevented.

Here, the circuit construction and the structures of the liquid crystal panel and back-light of the liquid crystal display in accordance with Embodiment 3 of the present invention are the same as those of Embodiment 1; therefore, the description thereof is omitted.

Figure 15:
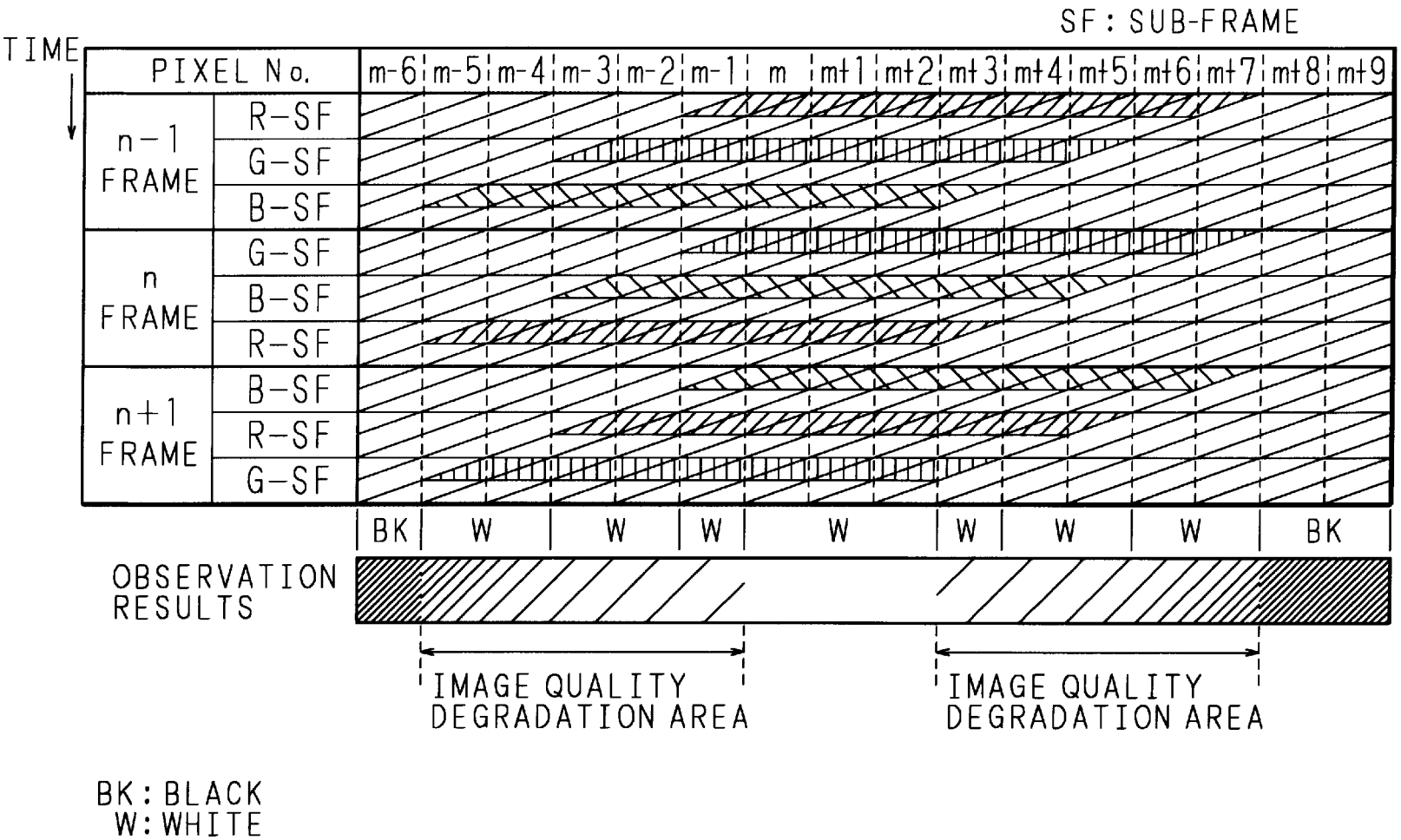
FIG. 15 is an explanatory drawing that shows a model of an animation picture recognized by an observer, on the liquid crystal panel of the liquid crystal display of Embodiment 3 of the present invention.

FIG. 15 is an explanatory drawing that shows a model of an animation picture recognized by an observer, on the liquid crystal panel of the liquid crystal display in accordance with Embodiment 3 of the present invention.

As described above, the back-light control circuit 35 controls the back-light 22 so that, in consecutive three frames, the orders of light emissions of the respective colors carried out by the LEDs in the respective sub-frames are not coincident with each other. Therefore, as illustrated in FIG. 15, the three-color display data of red, green and blue are always allowed to exist at the outline portion of an animation picture. Consequently, since no color separations take place, it is possible to prevent the outline portion of an animation picture from being observed as a rainbow colored portion, and it becomes possible to observe the entire image, for example, as a white image.

However, since the observer views the moving image while shifting his or her view point following the shift of the animation picture, the display data displayed in sub-frames coming later is observed as if it were drawn in a direction opposite to the shifting direction of the animation picture, as illustrated in FIG. 15. Therefore, as shown in "the results of observation" there still is an image-quality degradation area (monochrome display area) due to the difference in brightness in the animation picture.

However, as compared with the case in which rainbow colors are observed, this case having the monochrome display area is more advantageous since the degradation in the image quality is less conspicuous.

(Embodiment 4)

Figure 16:
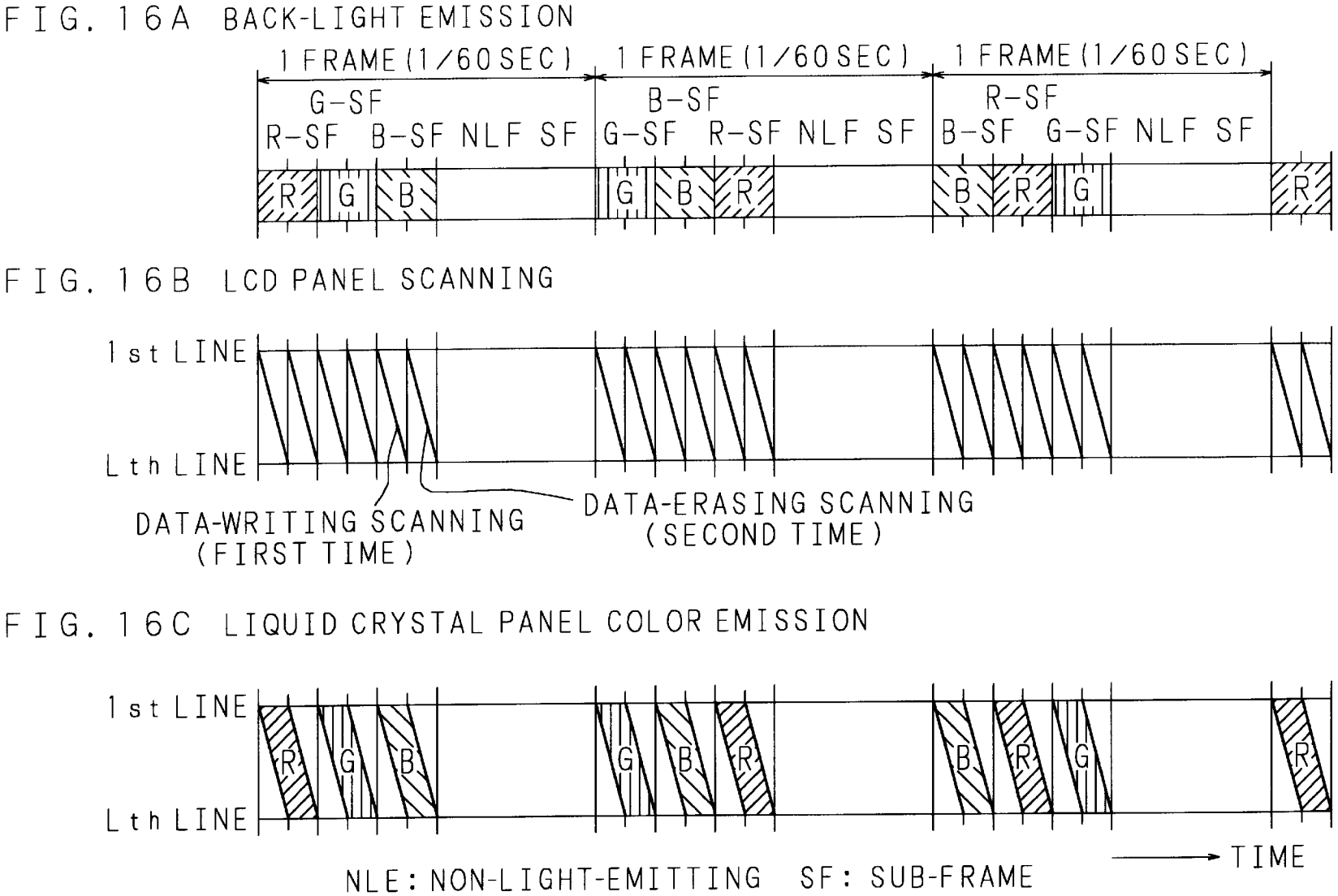

FIG. 16 is a time chart showing display controlling processes in a liquid crystal display in accordance with Embodiment 4 of the present invention.

FIG. 16A shows light-emitting timing of LEDs of respective red, green and blue colors in the back-light 22, FIG. 16B shows scanning timing of respective lines in the liquid crystal panel 21, and FIG. 16C shows light-emitting states of the liquid crystal panel 21.

As illustrated in FIG. 16A, in the same manner as Embodiment 1, in Embodiment 4 also, a display of 60 frames per second is carried out. Therefore, one frame period is a 1/60 second, and this one frame is further divided into six sub-frames each having a 1/360 second. Here, the back-light control circuit 35 controls the back-light 22 so that light emissions and non-light-emissions are carried out in the respective sub-frames within each frame in the following order.

First, in the first frame, the red LED emits light in the first sub-frame, the green LED emits light in the second sub-frame, and the blue LED emits light in the third sub-frame. Further, in the fourth to sixth sub-frames, the back-light 22 is turned off.

Next, in the second frame, the green LED emits light in the first sub-frame, the blue LED emits light in the second sub-frame, and the red LED emits light in the third sub-frame. Then, in the same manner as the first frame, in the fourth to sixth sub-frames, the back-light 22 is turned off.

Then, in the third frame, the blue LED emits light in the first sub-frame, the red LED emits light in the second sub-frame, and the green LED emits light in the third sub-frame. Moreover, in the same manner as the first frame, in the fourth to sixth sub-frames, the back-light 22 is turned off.

In this manner, the back-light control circuit 35 controls the back-light 22 so that, in consecutive three frames, the orders of light emissions of the respective colors carried out by the LEDs in the respective sub-frames are not coincident with each other.

As shown in FIG. 16B, with respect to the liquid crystal panel 21, data scanning processes are carried out twice in each of the red, green and blue sub-frames. Here, the timing adjustments are made so that the timing of the start (timing to the first line) of the first scanning (data-write scanning) is coincident with the timing of the start of each sub-frame, and so that the timing of the end (timing to the last line) of the second scanning (data-erase scanning) is coincident with the timing of the end of each sub-frame.

Upon carrying out the data-write scanning, a voltage corresponding to the pixel data PD is applied to each pixel in the liquid crystal panel 21 so that the adjustment of the transmittance is carried out. Thus, it is possible to perform a full-color display. Moreover, upon carrying out the data-erase scanning, the same voltage as that of the data-write scanning, with the reversed polarity is applied to each pixel in the liquid crystal panel 21 so that the display of each pixel in the liquid crystal panel 21 is erased, and the application of a DC component to the liquid crystal is prevented.

Here, the circuit construction and the structures of the liquid crystal panel and back-light of the liquid crystal display in accordance with Embodiment 4 of the present invention are the same as those of Embodiment 1; therefore, the description thereof is omitted.

Figure 17:
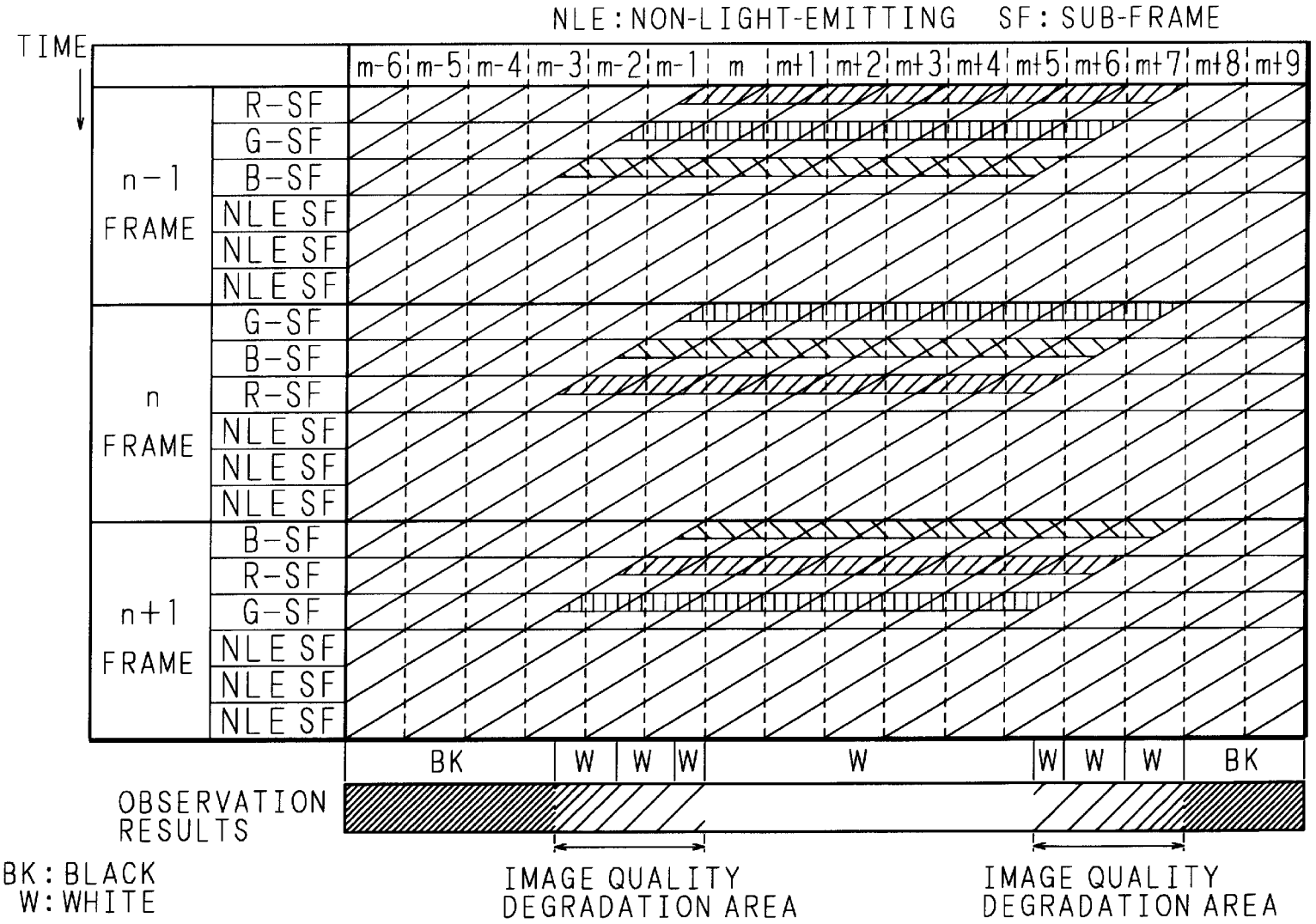
FIG. 17 is an explanatory drawing that shows a model of an animation picture recognized by an observer, on the liquid crystal panel of the liquid crystal display of Embodiment 4 of the present invention.

FIG. 17 is an explanatory drawing that shows a model of an animation picture recognized by an observer, on the liquid crystal panel of the liquid crystal display in accordance with Embodiment 4 of the present invention.

As described above, the back-light control circuit 35 controls the back-light 22 so that, in consecutive three frames, the orders of light emissions of the respective colors carried out by the LEDs in the respective sub-frames are not coincident with each other. Therefore, as illustrated in FIG. 17, the three-color display data of red, green and blue are always allowed to exist at the outline portion of an animation picture. Consequently, in the same manner as Embodiment 3, since no color separations take place, it is possible to prevent the outline portion of an animation picture from being observed as a rainbow colored portion.

Moreover, after the LEDs of red, green and blue have emitted light rays in the respective sub-frames, the back-light 22 is turned off for a ½ frame time (non-light-emitting SF in FIG. 17), with the result that, as shown in "the results of observation" in FIG. 17, the image-quality degradation area at the outline portion of an animation picture (an area in which a monochrome display is observed) can be narrowed.

As this invention may be embodied in several forms without departing from the spirit of essential characteristics thereof, the present embodiment is therefore illustrative-and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A liquid crystal display comprising:

a liquid crystal panel having a plurality of liquid crystal pixel electrodes arranged in a matrix form;

a back-light, placed on the rear face of the liquid crystal panel, for emitting at least three color light rays; and a back-light control circuit which allows the back-light to emit at least three color light rays sequentially color by color so as to differentiate the order of the light emissions within at least three consecutive frames.

2. A liquid crystal display comprising:

a liquid crystal panel having a plurality of liquid crystal pixel electrodes arranged in a matrix form and a plurality of switching elements placed correspondingly to the respective liquid crystal pixel electrodes;

a back-light, placed on the rear face of the liquid crystal panel, having light sources of three colors; and a light-source driving control circuit for controlling the driving processes of the respective light sources of the back-light, by allowing the back-light to emit light rays sequentially color by color in synchronism with three color display data in one frame, applied to the respective liquid crystal pixel electrodes, while driving the switching elements to turn ON/OFF corresponding to the display data, so as to carry out a color display, wherein the light-source driving control circuit controls the driving processes of the respective light sources so that, in each frame within consecutive three frames, among a first light-emitting order including the first, second and third colors in this order, a second light-emitting order including the second, third and first colors in this order, and a third light-emitting order including the third, first and second colors in this order, the respective light sources are driven in such a manner that the light-emitting order of each frame is different from the light-emitting orders of the other two frames.

3. A liquid crystal display, comprising:

a liquid crystal panel having a plurality of liquid crystal pixel electrodes arranged in a matrix form;

a back-light, placed on the rear face of a liquid crystal panel, for emitting a plurality of different color light rays sequentially color by color; and a back-light control circuit which emits the back-light sequentially color by color, and turns the back-light off for a predetermined time cyclically, wherein the back-light control circuit allows the plurality of different color light rays of the back-light to be emitted sequentially color by color so as not to have the same light-emitting order of colors in the consecutive plurality of frames.

4. A liquid crystal display comprising:

a liquid crystal panel having a plurality of liquid crystal pixel electrodes arranged in a matrix form and a plurality of switching elements placed correspondingly to the respective liquid crystal pixel electrodes;

a back-light, placed on the rear face of the liquid crystal panel, having light sources of three colors; and a light-source driving control circuit for controlling the driving processes of the respective light sources of the back-light, by allowing the back-light to emit light rays sequentially color by color in synchronism with three color display data in one frame, applied to the respective liquid crystal pixel electrodes, while driving the switching elements to turn ON/OFF corresponding to the display data, so as to carry out a color display, wherein the light-source driving control circuit controls the driving processes of the respective light sources so that, in each frame within consecutive three frames, among a first light-emitting order including the first, second and third colors in this order, a second light-emitting order including the second, third and first colors in this order, and a third light-emitting order including the third, first and second colors in this order, the respective light sources are driven in such a manner that the light-emitting order of each frame is different from the light-emitting orders of the other two frames, the driving processes of the respective light sources being controlled so that, in each of the frames, after the period for driving the third light source, a turn-off period for turning all the light sources off is provided.

5. The liquid crystal display according to claim 4 wherein the turn-off period is set to be approximately a ¼ frame time.

6. The liquid crystal display according to claim 5, wherein the turn-off period is set to be approximately a ½ frame time.

* * * * *